US011825576B1

(12) United States Patent
Chung et al.

(10) Patent No.: US 11,825,576 B1
(45) Date of Patent: Nov. 21, 2023

(54) LED ILLUMINATING DEVICE WITHOUT USING CAPACITOR

(71) Applicant: PARAGON SEMICONDUCTOR LIGHTING TECHNOLOGY CO., LTD., New Taipei (TW)

(72) Inventors: Chia-Tin Chung, Miaoli County (TW); Pei-Chun Liu, New Taipei (TW)

(73) Assignee: PARAGON SEMICONDUCTOR LIGHTING TECHNOLOGY CO., LTD., New Taipei (TW)

( * ) Notice: Subject to any disclaimer, the term of this patent is extended or adjusted under 35 U.S.C. 154(b) by 3 days.

(21) Appl. No.: 17/945,078

(22) Filed: Sep. 14, 2022

(30) Foreign Application Priority Data

Jun. 16, 2022 (TW) ..... 111206334

(51) Int. Cl.
*H05B 45/37* (2020.01)
*H05B 45/345* (2020.01)
*H05B 45/54* (2020.01)

(52) U.S. Cl.
CPC ..... *H05B 45/345* (2020.01); *H05B 45/54* (2020.01)

(58) Field of Classification Search
CPC ..... H05B 45/20; H05B 45/30; H05B 45/37; H05B 45/44; H05B 45/46; H05B 45/48; H05B 45/52; H05B 45/54
See application file for complete search history.

(56) References Cited

U.S. PATENT DOCUMENTS

| | | | | |
|---|---|---|---|---|
| 11,576,242 | B1 * | 2/2023 | Chung | H05B 45/37 |
| 11,647,569 | B2 * | 5/2023 | Archer | H05B 45/30 315/291 |
| 2015/0054408 | A1 * | 2/2015 | Wlodarczyk | H02M 1/32 315/137 |
| 2016/0161098 | A1 * | 6/2016 | Tudorica | H01L 33/60 362/249.14 |
| 2019/0230761 | A1 * | 7/2019 | Hwang | H05B 45/42 |

* cited by examiner

*Primary Examiner* — Tung X Le
(74) *Attorney, Agent, or Firm* — Li & Cai Intellectual Property Office

(57) ABSTRACT

An LED illuminating device without using a capacitor includes a surge absorber group, a three-phase rectifier bridge module, an LED chip group and a current-limiting chip group. The surge absorber group includes a first surge absorber electrically connected between the first and the second AC power input terminal, and a second surge absorber electrically connected between the second and the third AC power input terminal, and a third surge absorber electrically connected between the third and the first AC power input terminal. The three-phase rectifier bridge module is electrically connected to the first, the second and the third AC power input terminal. The LED chip group is electrically connected to the three-phase rectifier bridge module. The current-limiting chip group is electrically connected to the bridge rectifier group. The LED illuminating device can generate a lighting source through a three-phase power provided by a three-phase power supply.

10 Claims, 20 Drawing Sheets

LED ILLUMINATING DEVICE WITHOUT USING CAPACITOR

CROSS-REFERENCE TO RELATED PATENT APPLICATION

This application claims the benefit of priority to Taiwan Patent Application No. 111206334, filed on Jun. 16, 2022. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an LED illuminating device, and more particularly to an LED illuminating device without using a capacitor.

BACKGROUND OF THE DISCLOSURE

In the related art, an illuminating device can be equipped with a plurality of light-emitting diode (LED) chips to provide a light source that is required by a user. However, in order to have energy storage and filtering functions, the illuminating device needs to be used with capacitors.

SUMMARY OF THE DISCLOSURE

In response to the above-referenced technical inadequacy, the present disclosure provides an LED illuminating device (or an LED lighting device) without using a capacitor.

In one aspect, the present disclosure provides an LED illuminating device without using a capacitor, which includes a circuit substrate, a surge absorber group, a bridge rectifier group, a first LED chip group, a second LED chip group, a third LED chip group and a current-limiting chip group. The circuit substrate is configured without the capacitor, in which the circuit substrate includes a first alternating current (AC) power input terminal, a second AC power input terminal and a third AC power input terminal that are electrically connected to a three-phase power supply. The surge absorber group is disposed on the circuit substrate and electrically connected to the circuit substrate, in which the surge absorber group includes a first surge absorber electrically connected between the first AC power input terminal and the second AC power input terminal, a second surge absorber electrically connected between the second AC power input terminal and the third AC power input terminal, and a third surge absorber electrically connected between the third AC power input terminal and the first AC power input terminal. The bridge rectifier group is disposed on the circuit substrate and electrically connected to the circuit substrate, in which the bridge rectifier group includes a first bridge rectifier electrically connected between the first AC power input terminal and the second AC power input terminal, a second bridge rectifier electrically connected between the second AC power input terminal and the third AC power input terminal, and a third bridge rectifier electrically connected between the third AC power input terminal and the first AC power input terminal. The first LED chip group is disposed on the circuit substrate and electrically connected to the circuit substrate, in which the first LED chip group is electrically connected to the first bridge rectifier, and the first LED chip group includes a plurality of first LED chips. The second LED chip group is disposed on the circuit substrate and electrically connected to the circuit substrate, in which the second LED chip group is electrically connected to the second bridge rectifier, and the second LED chip group includes a plurality of second LED chips. The third LED chip group is disposed on the circuit substrate and electrically connected to the circuit substrate, in which the third LED chip group is electrically connected to the third bridge rectifier, and the third LED chip group includes a plurality of third LED chips. The current-limiting chip group is disposed on the circuit substrate and electrically connected to the circuit substrate, in which the current-limiting chip group is electrically connected to the bridge rectifier group.

In one of the possible or preferred embodiments, the LED illuminating device without using the capacitor further includes a fuse chip group and a resistor chip group. The fuse chip group disposed on the circuit substrate and electrically connected to the circuit substrate, in which the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier. The resistor chip group is disposed on the circuit substrate and electrically connected to the circuit substrate, in which the resistor chip group includes a first resistor chip, a second resistor chip and a third resistor chip. The current-limiting chip group includes a first current-limiting chip electrically connected between the first LED chip group and the first bridge rectifier, a second current-limiting chip electrically connected between the second LED chip group and the second bridge rectifier, and a third current-limiting chip electrically connected between the third LED chip group and the third bridge rectifier. The first LED chips of the first LED chip group are electrically connected in series between the first bridge rectifier and the first current-limiting chip, the second LED chips of the second LED chip group are electrically connected in series between the second bridge rectifier and the second current-limiting chip, and the third LED chips of the third LED chip group are electrically connected in series between the third bridge rectifier and the third current-limiting chip. The first resistor chip is electrically connected to the first current-limiting chip, the second resistor chip is electrically connected to the second current-limiting chip, and the third resistor chip is electrically connected to the third current-limiting chip.

In one of the possible or preferred embodiments, the LED illuminating device without using the capacitor further includes a fuse chip group and a resistor chip group. The fuse chip group is disposed on the circuit substrate and electrically connected to the circuit substrate, in which the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier. The resistor chip group is disposed on the circuit substrate and electrically connected to the circuit substrate, in which the resistor chip group includes a plurality of first resistor chips, a plurality of second resistor chips and a plurality of third resistor chips. The current-limiting chip group includes a plurality of first current-limiting chips electrically connected between the first LED chip group and the first bridge rectifier, a plurality of second current-limiting chips electrically connected between the second LED chip group and the second bridge rectifier, and a plurality of third current-limiting chips electrically connected between the third LED chip group and the third bridge rectifier, the first current-limiting chips are arranged in parallel with each other, the second current-limiting chips are arranged in parallel with each other, and the third current-limiting chips are arranged in parallel with each other. The first LED chips of the first LED chip group are divided into a first LED chip section including at least two of the first LED chips arranged in series, a second LED chip section including at least another two of the first LED chips arranged in series, and a third LED chip section including at least yet another two of the first LED chips arranged in series, and the first LED chip section, the second LED chip section and the third LED chip section of the first LED chip group are arranged in series. One of the first current-limiting chips is electrically connected in parallel between the first LED chip section and the second LED chip section of the first LED chip group, another one of the first current-limiting chips is electrically connected in parallel between the second LED chip section and the third LED chip section of the first LED chip group, and yet another one of the first current-limiting chips is electrically connected in series to the third LED chip section of the first LED chip group. The second LED chips of the second LED chip group are divided into a first LED chip section including at least two of the second LED chips arranged in series, a second LED chip section including at least another two of the second LED chips arranged in series, and a third LED chip section including at least yet another two of the second LED chips arranged in series, and the first LED chip section, the second LED chip section and the third LED chip section of the second LED chip group are arranged in series. One of the second current-limiting chips is electrically connected in parallel between the first LED chip section and the second LED chip section of the second LED chip group, another one of the second current-limiting chips is electrically connected in parallel between the second LED chip section and the third LED chip section of the second LED chip group, and yet another one of the second current-limiting chips is electrically connected in series to the third LED chip section of the second LED chip group. The third LED chips of the third LED chip group are divided into a first LED chip section including at least two of the third LED chips arranged in series, a second LED chip section including at least another two of the third LED chips arranged in series, and a third LED chip section including at least yet another two of the third LED chips arranged in series, and the first LED chip section, the second LED chip section and the third LED chip section of the third LED chip group are arranged in series. One of the third current-limiting chips is electrically connected in parallel between the first LED chip section and the second LED chip section of the third LED chip group, another one of the third current-limiting chips is electrically connected in parallel between the second LED chip section and the third LED chip section of the third LED chip group, and yet another one of the third current-limiting chips is electrically connected in series to the third LED chip section of the third LED chip group. The first resistor chips are respectively electrically connected to the first current-limiting chips, the second resistor chips are respectively electrically connected to the second current-limiting chips, and the third resistor chips are respectively electrically connected to the third current-limiting chips.

In one of the possible or preferred embodiments, the LED illuminating device without using the capacitor further includes a fuse chip group and a resistor chip group. The fuse chip group disposed on the circuit substrate and electrically connected to the circuit substrate, in which the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier. The resistor chip group is disposed on the circuit substrate and electrically connected to the circuit substrate, in which the resistor chip group includes a plurality of first resistor chips, a plurality of second resistor chips and a plurality of third resistor chips. The current-limiting chip group includes a plurality of first current-limiting chips arranged in parallel with each other, a plurality of second current-limiting chips arranged in parallel with each other, and a plurality of third current-limiting chips arranged in parallel with each other. The first LED chips of the first LED chip group are divided into a first LED chip section including at least two of the first LED chips arranged in series, and a second LED chip section including at least another two of the first LED chips arranged in series, the first LED chip section and the second LED chip section of the first LED chip group are arranged in parallel, and the first LED chip section and the second LED chip section of the first LED chip group are electrically connected with each other through a first unidirectional conduction chip. One of the first current-limiting chips is electrically connected in series to the first LED chip section of the first LED chip group, another one of the first current-limiting chips is electrically connected in parallel to the first LED chip section of the first LED chip group, and yet another one of the first current-limiting chips is electrically connected in parallel to the second LED chip section of the first LED chip group. The second LED chips of the second LED chip group are divided into a first LED chip section including at least two of the second LED chips arranged in series, and a second LED chip section including at least another two of the second LED chips arranged in series, the first LED chip section and the second LED chip section of the second LED chip group are arranged in parallel, and the first LED chip section and the second LED chip section of the second LED chip group are electrically connected with each other through a second unidirectional conduction chip. One of the second current-limiting chips is electrically connected in series to the first LED chip section of the second LED chip group, another one of the second current-limiting chips is electrically connected in parallel to the first LED chip section of the second LED chip group, and yet another one of the second current-limiting chips is electrically connected in parallel to the second LED chip section of the second LED chip group. The third LED chips of the third LED chip group are divided into a first LED chip section including at least two of the third LED chips arranged in series, and a second LED chip section including at least another two of the third LED chips arranged in series, the first LED chip section and the second LED chip section of the third LED chip group are arranged in parallel, and the first LED chip section and the second LED chip section of the third LED chip group are electrically connected with each other through a third unidirectional conduction chip. One of the third current-limiting chips is electrically connected in series to the first LED chip section of the third LED chip group, another one of the third current-limiting chips is electrically connected in parallel to the first LED chip section of the third LED chip group, and yet another one of the third current-limiting chips is electrically connected in parallel to the second LED chip section of the third LED chip group. The first resistor chips are respectively electrically connected to the first current-limiting chips, the second resistor chips are respectively electrically connected to the second current-limiting chips, and the third resistor chips are respectively electrically connected to the third current-limiting chips.

In one of the possible or preferred embodiments, the LED illuminating device without using the capacitor further includes a fuse chip group and a resistor chip group. The fuse chip group is disposed on the circuit substrate and electrically connected to the circuit substrate, in which the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier. The resistor chip group is disposed on the circuit substrate and electrically connected to the circuit substrate, in which the resistor chip group includes at least one first resistor chip, at least one second resistor chip and at least one third resistor chip. The first LED chip group, the second LED chip group and the third LED chip group are disposed on the same circuit substrate and electrically connected to the same circuit substrate, and the current-limiting chip group includes at least one first current-limiting chip, at least one second current-limiting chip, and at least one third current-limiting chip. The first surge absorber, the first fuse chip, the first bridge rectifier, the first LED chip group, the at least one first current-limiting chip and the at least one first resistor chip cooperate with each other to form a first light-emitting assembly. The second surge absorber, the second fuse chip, the second bridge rectifier, the second LED chip group, the at least one second current-limiting chip and the at least one second resistor chip cooperate with each other to form a second light-emitting assembly. The third surge absorber, the third fuse chip, the third bridge rectifier, the third LED chip group, the at least one third current-limiting chip and the at least one third resistor chip cooperate with each other to form a third light-emitting assembly.

In another aspect, the present disclosure provides an LED illuminating device without using a capacitor, which includes a circuit substrate, a surge absorber group, a three-phase rectifier bridge module, an LED chip group and a current-limiting chip group. The circuit substrate is configured without the capacitor, in which the circuit substrate includes a first alternating current (AC) power input terminal, a second AC power input terminal and a third AC power input terminal that are electrically connected to a three-phase power supply. The surge absorber group is disposed on the circuit substrate and electrically connected to the circuit substrate, in which the surge absorber group includes a first surge absorber electrically connected between the first AC power input terminal and the second AC power input terminal, a second surge absorber electrically connected between the second AC power input terminal and the third AC power input terminal, and a third surge absorber electrically connected between the third AC power input terminal and the first AC power input terminal. The three-phase rectifier bridge module is disposed on the circuit substrate and electrically connected to the circuit substrate, in which the three-phase rectifier bridge module is electrically connected to the first AC power input terminal, the second AC power input terminal and the third AC power input terminal. The LED chip group is disposed on the circuit substrate and electrically connected to the circuit substrate, in which the LED chip group is electrically connected to the three-phase rectifier bridge module, and the LED chip group includes a plurality of LED chips. The current-limiting chip group is disposed on the circuit substrate and electrically connected to the circuit substrate, in which the current-limiting chip group is electrically connected to the three-phase rectifier bridge module.

In one of the possible or preferred embodiments, the LED illuminating device without using the capacitor further includes a fuse chip group and a resistor chip group. The fuse chip group is disposed on the circuit substrate and electrically connected to the circuit substrate, in which the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module. The resistor chip group is disposed on the circuit substrate and electrically connected to the circuit substrate, in which the resistor chip group includes a resistor chip. The current-limiting chip group includes a current-limiting chip electrically connected between the LED chip group and the three-phase rectifier bridge module. The LED chips of the LED chip group are electrically connected in series between the three-phase rectifier bridge module and the current-limiting chip. The resistor chip is electrically connected to the current-limiting chip.

In one of the possible or preferred embodiments, the LED illuminating device without using the capacitor further includes a fuse chip group and a resistor chip group. The fuse chip group is disposed on the circuit substrate and electrically connected to the circuit substrate, in which the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module. The resistor chip group is disposed on the circuit substrate and electrically connected to the circuit substrate, in which the resistor chip group includes a plurality of resistor chips. The current-limiting chip group includes a plurality of current-limiting chips electrically connected between the LED chip group and the three-phase rectifier bridge module, and the current-limiting chips are arranged in parallel with each other. The LED chips of the LED chip group are divided into a first LED chip section including at least two of the LED chips arranged in series, a second LED chip section including at least another two of the LED chips arranged in series, and a third LED chip section including at least yet another two of the LED chips arranged in series, and the first LED chip section, the second LED chip section and the third LED chip section of the LED chip group are arranged in series. One of the current-limiting chips is electrically connected in parallel between the first LED chip section and the second LED chip section of the LED chip group, another one of the current-limiting chips is electrically connected in parallel between the second LED chip section and the third LED chip section of the LED chip group, and yet another one of the current-limiting chips is electrically connected in series to the third LED chip section of the LED chip group. The resistor chips are respectively electrically connected to the current-limiting chips.

In one of the possible or preferred embodiments, the LED illuminating device without using the capacitor further includes a fuse chip group and a resistor chip group. The fuse chip group is disposed on the circuit substrate and electrically connected to the circuit substrate, in which the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module. The resistor chip group is disposed on the circuit substrate and electrically connected to the circuit substrate, in which the resistor chip group includes a plurality of resistor chips. The current-limiting chip group includes a plurality of current-limiting chips arranged in parallel with each other. The LED chips of the LED chip group are divided into a first LED chip section including at least two of the LED chips arranged in series, and a second LED chip section including at least another two of the LED chips arranged in series, the first LED chip section and the second LED chip section of the LED chip group are arranged in parallel, and the first LED chip section and the second LED chip section of the LED chip group are electrically connected with each other through a unidirectional conduction chip. One of the current-limiting chips is electrically connected in parallel between the first LED chip section and the second LED chip section of the LED chip group, another one of the current-limiting chips is electrically connected in parallel to the first LED chip section of the LED chip group, and yet another one of the current-limiting chips is electrically connected in series to the second LED chip section of the LED chip group. The resistor chips are respectively electrically connected to the current-limiting chips.

In one of the possible or preferred embodiments, the LED illuminating device without using the capacitor further includes a fuse chip group and a resistor chip group. The fuse chip group is disposed on the circuit substrate and electrically connected to the circuit substrate, in which the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module. The resistor chip group is disposed on the circuit substrate and electrically connected to the circuit substrate, in which the resistor chip group includes at least one resistor chip. The first surge absorber, the second surge absorber, the third surge absorber, the first fuse chip, the second fuse chip, the third fuse chip, the three-phase rectifier bridge module, the LED chip group, the at least one current-limiting chip of the current-limiting chip group, and the at least one resistor chip cooperate with each other to form a light-emitting assembly. The three-phase rectifier bridge module includes a first electronic component, a second electronic component, a third electronic component, a fourth electronic component, a fifth electronic component and a sixth electronic component, the first AC power input terminal is electrically connected to the first electronic component and the second electronic component, the second AC power input terminal is electrically connected to the third electronic component and the fourth electronic component, and the third AC power input terminal is electrically connected to the fifth electronic component and the sixth electronic component.

One beneficial effect of the present disclosure is that the LED illuminating device can generate a lighting source required by a user through a three-phase power that can be provided by the first AC power input terminal, the second AC power input terminal and the third AC power input terminal of the three-phase power supply by cooperation of the surge absorber group, the bridge rectifier group, the first LED chip group, the second LED chip group, the third LED chip group and the current-limiting chip group.

Another beneficial effect of the present disclosure is that the LED illuminating device can generate a lighting source required by a user through a three-phase power that can be provided by the first AC power input terminal, the second AC power input terminal and the third AC power input terminal of the three-phase power supply by cooperation of the surge absorber group, the three-phase rectifier bridge module, the LED chip group and the current-limiting chip group.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
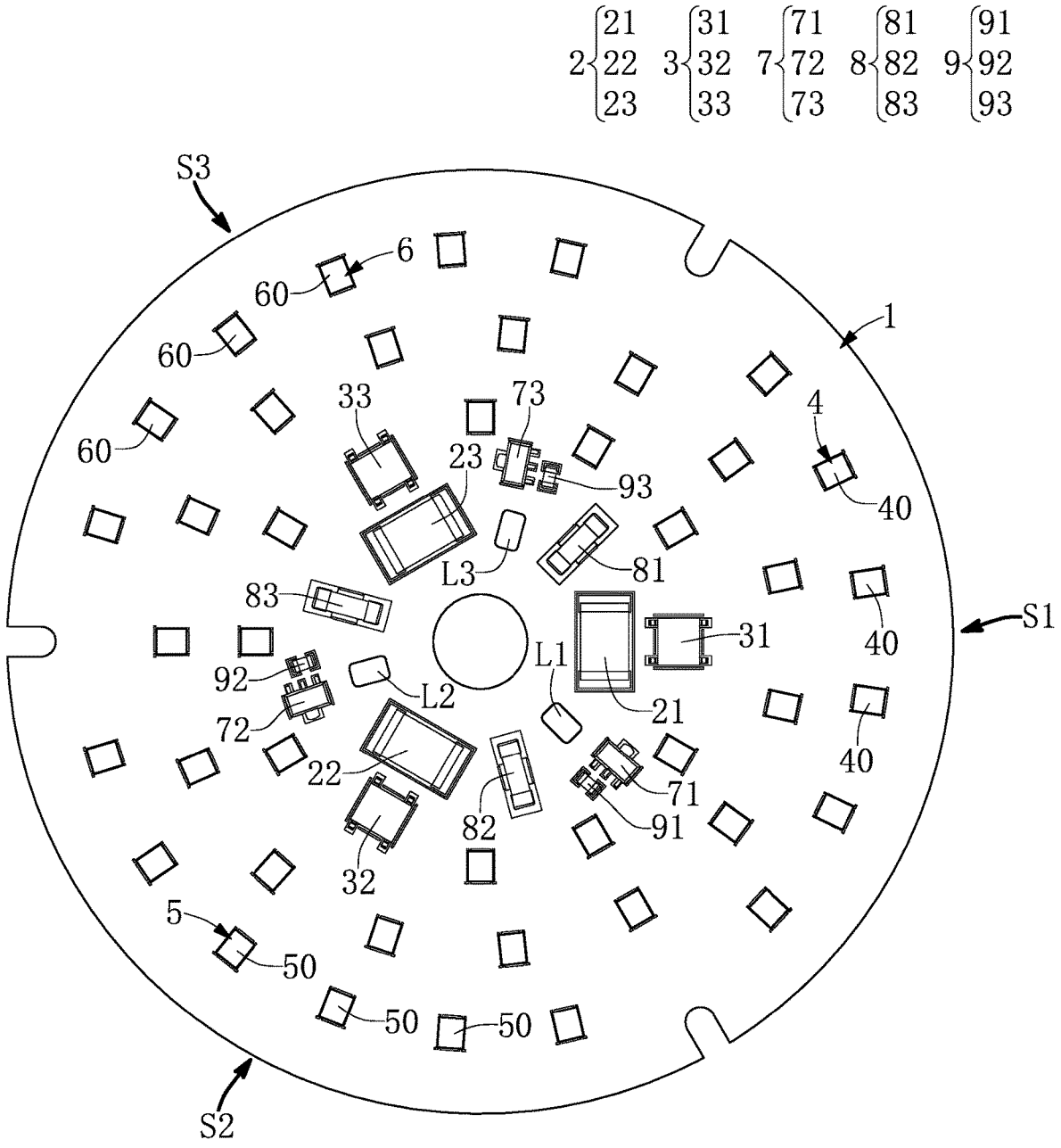
FIG. 1 is a schematic top view of an LED illuminating device according to a first embodiment of the present disclosure (when a plurality of first LED chips, a plurality of second LED chips and a plurality of third LED chips are electrically connected to a circuit substrate by SMT)

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
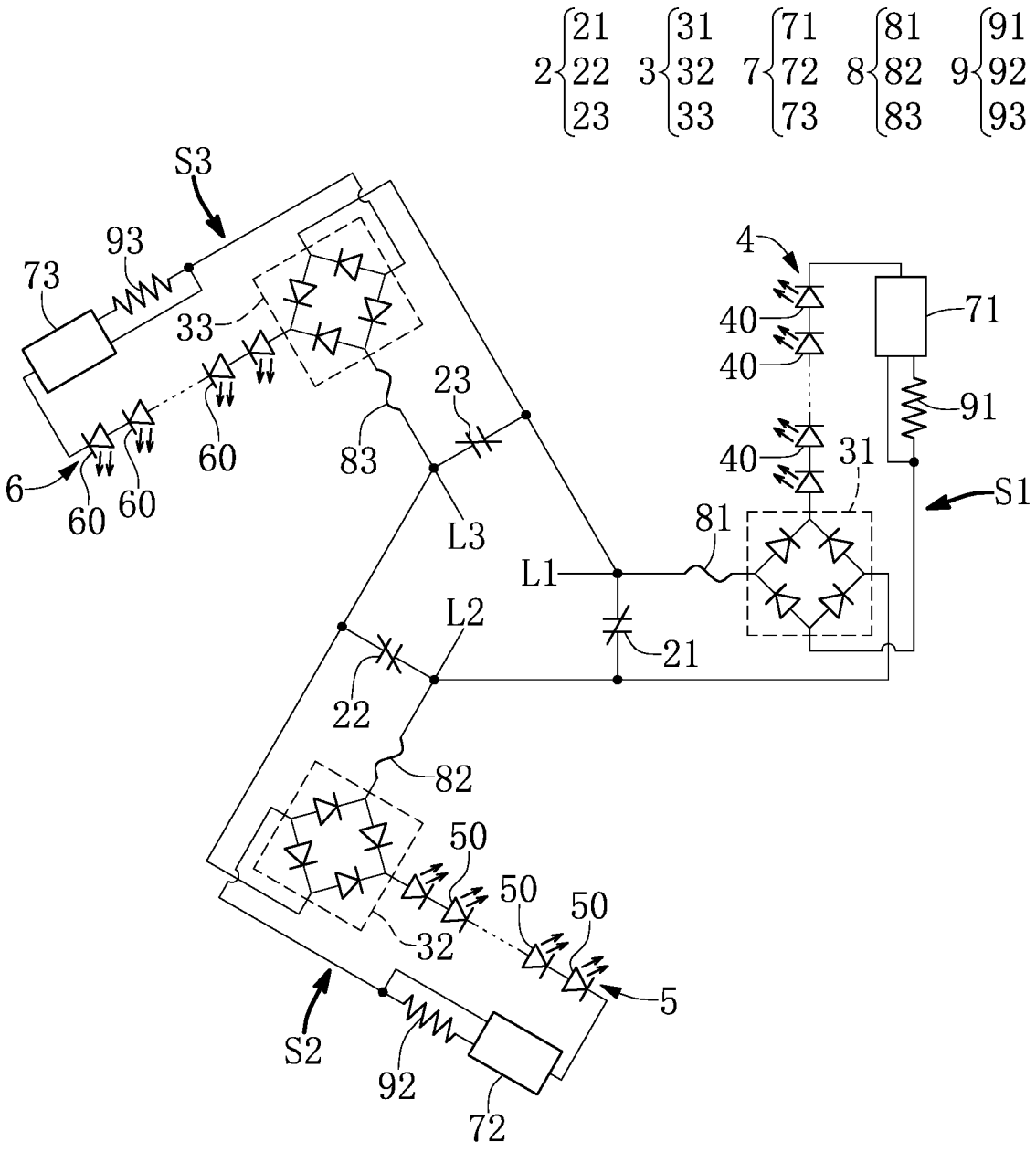
FIG. 2 is a schematic circuit diagram of the LED illuminating device according to the first embodiment of the present disclosure.
Figure 3:
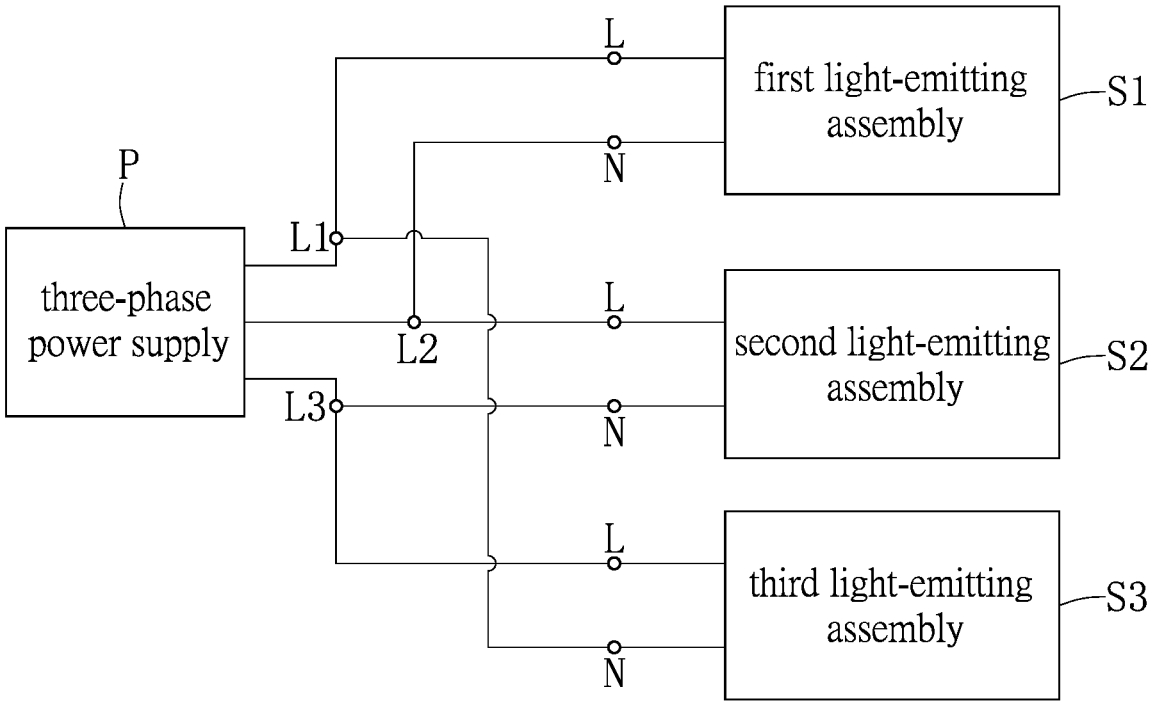
FIG. 3 is a functional block diagram of the LED illuminating device being electrically connected to a three-phase power supply according to the first embodiment of the present disclosure.

Referring to FIG. 1 to FIG. 3, a first embodiment of the present disclosure provides an LED illuminating device without using a capacitor, which at least includes a circuit substrate 1, a surge absorber group 2, a bridge rectifier group 3, a first LED chip group 4, a second LED chip group 5, a third LED chip group 6 and a current-limiting chip group 7.

Firstly, referring to FIG. 1 and FIG. 3, there is not any capacitor disposed on the circuit substrate 1, and the circuit substrate 1 includes a first AC power input terminal L1, a second AC power input terminal L2 and a third AC power input terminal L3 that are electrically connected to a three-phase power supply P. For example, the circuit substrate 1 may be any kind of circuit board, and the three-phase power supply P includes a first AC power output terminal (not labeled), a second AC power output terminal (not labeled) and a third AC power output terminal (not labeled) electrically connected to the first AC power input terminal L1, the second AC power input terminal L2 and the third AC power input terminal L3 of the circuit substrate 1, respectively. However, the aforementioned details are disclosed for exemplary purposes only, and are not meant to limit the scope of the present disclosure.

Moreover, referring to FIG. 1 and FIG. 2, the surge absorber group 2 is disposed on the circuit substrate 1 and electrically connected to the circuit substrate 1, and the surge absorber group 2 includes a first surge absorber 21 (or a first anti-surge device, or a first varistor), a second surge absorber 22 (or a first anti-surge device, or a first varistor), and a third surge absorber 23 (or a first anti-surge device, or a first varistor) for absorbing a surge voltage (or a voltage of a voltage surge). More particularly, the first surge absorber 21 is electrically connected between the first AC power input terminal L1 and the second AC power input terminal L2 to serve as a first surge protection between the first AC power input terminal L1 and the second AC power input terminal L2. The second surge absorber 22 is electrically connected between the second AC power input terminal L2 and the third AC power input terminal L3 to serve as a second surge protection between the second AC power input terminal L2 and the third AC power input terminal L3. The third surge absorber 23 is electrically connected between the third AC power input terminal L3 and the first AC power input terminal L1 to serve as a third surge protection between the third AC power input terminal L3 and the first AC power input terminal L1.

Furthermore, referring to FIG. 1 and FIG. 2, the bridge rectifier group 3 is disposed on the circuit substrate 1 and electrically connected to the circuit substrate 1, and the bridge rectifier group 3 includes a first bridge rectifier 31, a second bridge rectifier 32 and a third bridge rectifier 33 for converting the alternating current (AC) provided by the three-phase power supply P into the direct current (DC). More particularly, the first bridge rectifier 31 is electrically connected between the first AC power input terminal L1 and the second AC power input terminal L2 for converting the alternating current provided by the three-phase power supply P into the direct current (i.e., rectification for the first phase). The second bridge rectifier 32 is electrically connected between the second AC power input terminal L2 and the third AC power input terminal L3 for converting the alternating current provided by the three-phase power supply P into the direct current (i.e., rectification for the second phase). The third bridge rectifier 33 is electrically connected between the third AC power input terminal L3 and the first AC power input terminal L1 for converting the alternating current provided by the three-phase power supply P into the direct current (i.e., rectification for the third phase). For example, the first bridge rectifier 31, the second bridge rectifier 32 and the third bridge rectifier 33 may be chip-type bridge rectifiers. However, the aforementioned details are disclosed for exemplary purposes only, and are not meant to limit the scope of the present disclosure.

In addition, referring to FIG. 1 and FIG. 2, the first LED chip group 4 is disposed on the circuit substrate 1 and electrically connected to the circuit substrate 1, the first LED chip group 4 is electrically connected to the first bridge rectifier 31, and the first LED chip group 4 includes a plurality of first LED chips 40. The second LED chip group 5 is disposed on the circuit substrate 1 and electrically connected to the circuit substrate 1, the second LED chip group 5 is electrically connected to the second bridge rectifier 32, and the second LED chip group 5 includes a plurality of second LED chips 50. The third LED chip group 6 is disposed on the circuit substrate 1 and electrically connected to the circuit substrate 1, the third LED chip group 6 is electrically connected to the third bridge rectifier 33, and the third LED chip group 6 includes a plurality of third LED chips 60. For example, the first LED chip group 4, the second LED chip group 5 and the third LED chip group 6 are disposed on the same circuit substrate 1 and electrically connected to the same circuit substrate 1, and the first LED chips 40, the second LED chips 50 and the third LED chips 60 can be used to provide light sources having the same or different wavelengths. In addition, the first LED chips 40, the second LED chips 50 and the third LED chips 60 can be electrically connected to the circuit substrate 1 by means of surface mount technology (SMT). That is to say, when the LED chip has been packaged, the packaged LED chip can be electrically connected to the circuit substrate 1 by SMT. However, the aforementioned details are disclosed for exemplary purposes only, and are not meant to limit the scope of the present disclosure.

Moreover, referring to FIG. 1 and FIG. 2, the current-limiting chip group 7 is disposed on the circuit substrate 1 and electrically connected to the circuit substrate 1, and the current-limiting chip group 7 is electrically connected to the bridge rectifier group 3. More particularly, the current-limiting chip group 7 includes a first current-limiting chip 71, a second current-limiting chip 72 and a third current-limiting chip 73 for limiting the maximum current of the LED illuminating device and providing surge protection of at least 500V. The first current-limiting chip 71 is electrically connected between the first LED chip group 4 and the first bridge rectifier 31 for limiting the current between the first AC power input terminal L1 and the second AC power input terminal L2 (i.e., the current limit for the first phase). The second current-limiting chip 72 is electrically connected between the second LED chip group 5 and the second bridge rectifier 32 for limiting the current between the second AC power input terminal L2 and the third AC power input terminal L3 (i.e., the current limit for the second phase). The third current-limiting chip 73 is electrically connected between the third LED chip group 6 and the third bridge rectifier 33 for limiting the current between the third AC power input terminal L3 and the first AC power input terminal L1 (i.e., the current limit for the third phase).

It should be noted that referring to FIG. 1 and FIG. 2, the LED illuminating device provided by the first embodiment of the present disclosure further includes a fuse chip group 8 and a resistor chip group 9. More particularly, the fuse chip group 8 is disposed on the circuit substrate 1 and electrically connected to the circuit substrate 1, and the fuse chip group 8 includes a first fuse chip 81, a second fuse chip 82 and a third fuse chip 83 for providing current overload protection. The first fuse chip 81 is electrically connected to the first AC power input terminal L1 and the first bridge rectifier 31 to provide current overload protection for the first AC power input terminal L1. The second fuse chip 82 is electrically connected between the second AC power input terminal L2 and the second bridge rectifier 32 to provide current overload protection for the second AC power input terminal L2. The third fuse chip 83 is electrically connected between the third AC power input terminal L3 and the third bridge rectifier 33 to provide current overload protection for the third AC power input terminal L3. The resistor chip group 9 is disposed on the circuit substrate 1 and electrically connected to the circuit substrate 1, and the resistor chip group 9 includes a first resistor chip 91, a second resistor chip 92 and a third resistor chip 93 for setting the current-limiting value of the current-limiting chip group 7. The first resistor chip 91 is electrically connected to the first current-limiting chip 71 for setting the current-limiting value of the first current-limiting chip 71. The second resistor chip 92 is electrically connected to the second current-limiting chip 72 for setting the current-limiting value of the second current-limiting chip 72. The third resistor chip 93 is electrically connected to the third current-limiting chip 73 for setting the current-limiting value of the third current-limiting chip 73.

For example, referring to FIG. 1 and FIG. 2, the first LED chips 40 of the first LED chip group 4 can be electrically connected in series between the first bridge rectifier 31 and the first current-limiting chip 71. The second LED chips 50 of the second LED chip group 5 can be electrically connected in series between the second bridge rectifier 32 and the second current-limiting chip 72. The third LED chips 60 of the third LED chip group 6 can be electrically connected in series between the third bridge rectifier 33 and the third current-limiting chip 73. However, the aforementioned details are disclosed for exemplary purposes only, and are not meant to limit the scope of the present disclosure.

It should be noted that referring to FIG. 1 to FIG. 3, the first surge absorber 21, the first fuse chip 81, the first bridge rectifier 31, the first LED chip group 4, the first current-limiting chip 71 and the first resistor chip 91 can cooperate with each other to form a first light-emitting assembly S1 (such as a first single-phase light source having a live wire L and a neutral wire N, and using the first AC power input terminal L1 and the second AC power input terminal L2 as a power supply). Moreover, the second surge absorber 22, the second fuse chip 82, the second bridge rectifier 32, the second LED chip group 5, the second current-limiting chip 72 and the second resistor chip 92 can cooperate with each other to form a second light-emitting assembly S2 (such as a second single-phase light source having a live wire L and a neutral wire N, and using the second AC power input terminal L2 and the third AC power input terminal L3 as a power supply). Furthermore, the third surge absorber 23, the third fuse chip 83, the third bridge rectifier 33, the third LED chip group 6, the third current-limiting chip 73 and the third resistor chip 93 can cooperate with each other to form a third light-emitting assembly S3 (such as a third single-phase light source having a live wire L and a neutral wire N, and using the third AC power input terminal L3 and the first AC power input terminal L1 as a power supply). In addition, the first light-emitting assembly S1 used as the first single-phase light source, the second light-emitting assembly S2 used as the second single-phase light source, and the third light-emitting assembly S3 used as the third single-phase light source have the same load.

Figure 4:
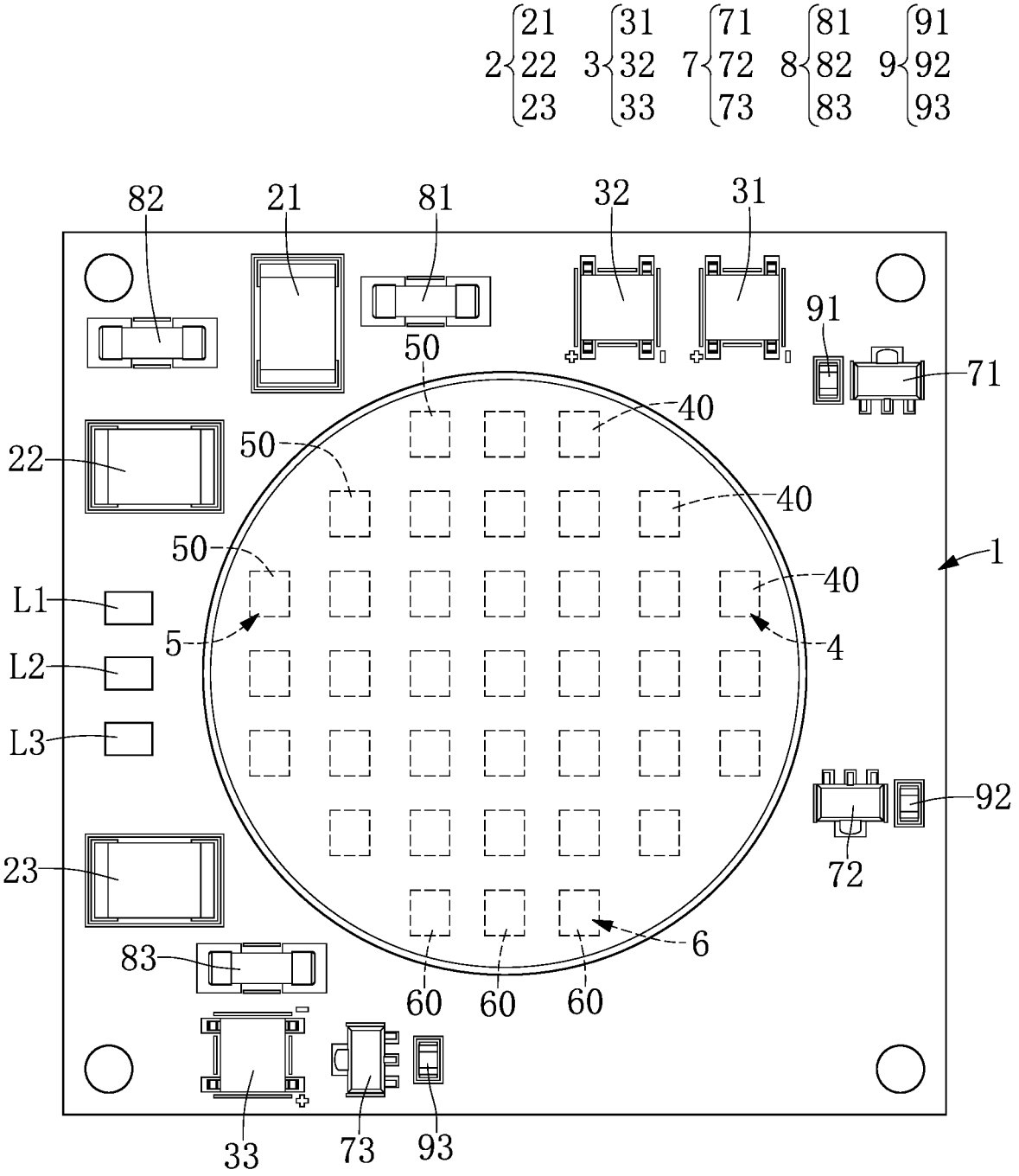
FIG. 4 is a schematic top view of another LED illuminating device according to the first embodiment of the present disclosure (when the first LED chips, the second LED chips and the third LED chips are electrically connected to the circuit substrate by COB)

It should be noted that, for example, as shown in FIG. 4, the first embodiment of the present disclosure further provides another LED illuminating device, and the first LED chips 40, the second LED chips 50 and the third LED chips 60 can be electrically connected to the circuit substrate 1 by means of chip on board (COB). That is to say, when the LED chip is a bare die and has not been packaged, the bare LED chip can be electrically connected to the circuit substrate 1 by COB, and then the bare LED chip can be covered with a light-transmitting protective layer or a fluorescent layer. However, the aforementioned details are disclosed for exemplary purposes only, and are not meant to limit the scope of the present disclosure.

Second Embodiment

Figure 5:
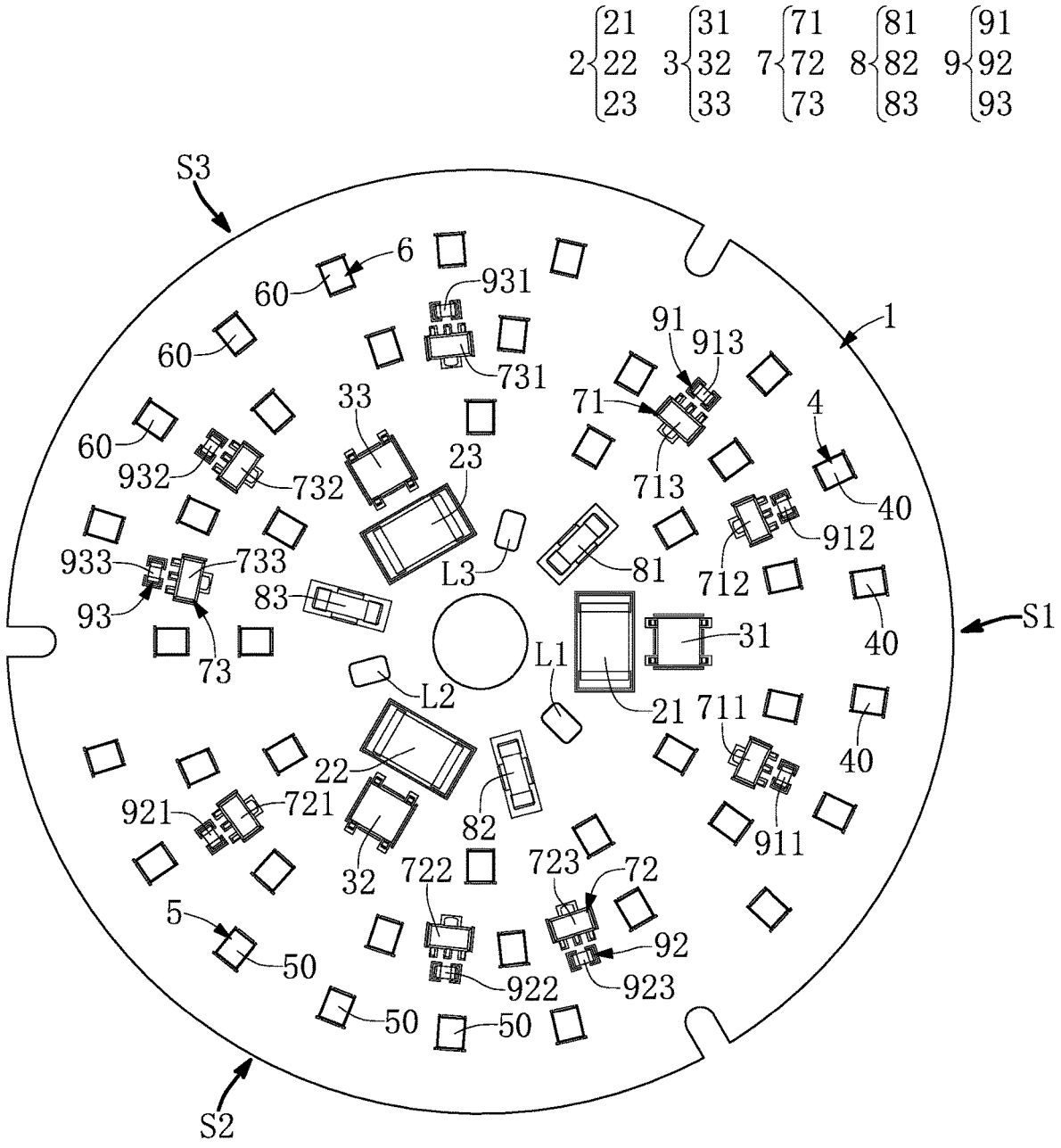
FIG. 5 is a schematic top view of the LED illuminating device according to a second embodiment of the present disclosure (when the first LED chips, the second LED chips and the third LED chips are electrically connected to the circuit substrate by SMT)
Figure 6:
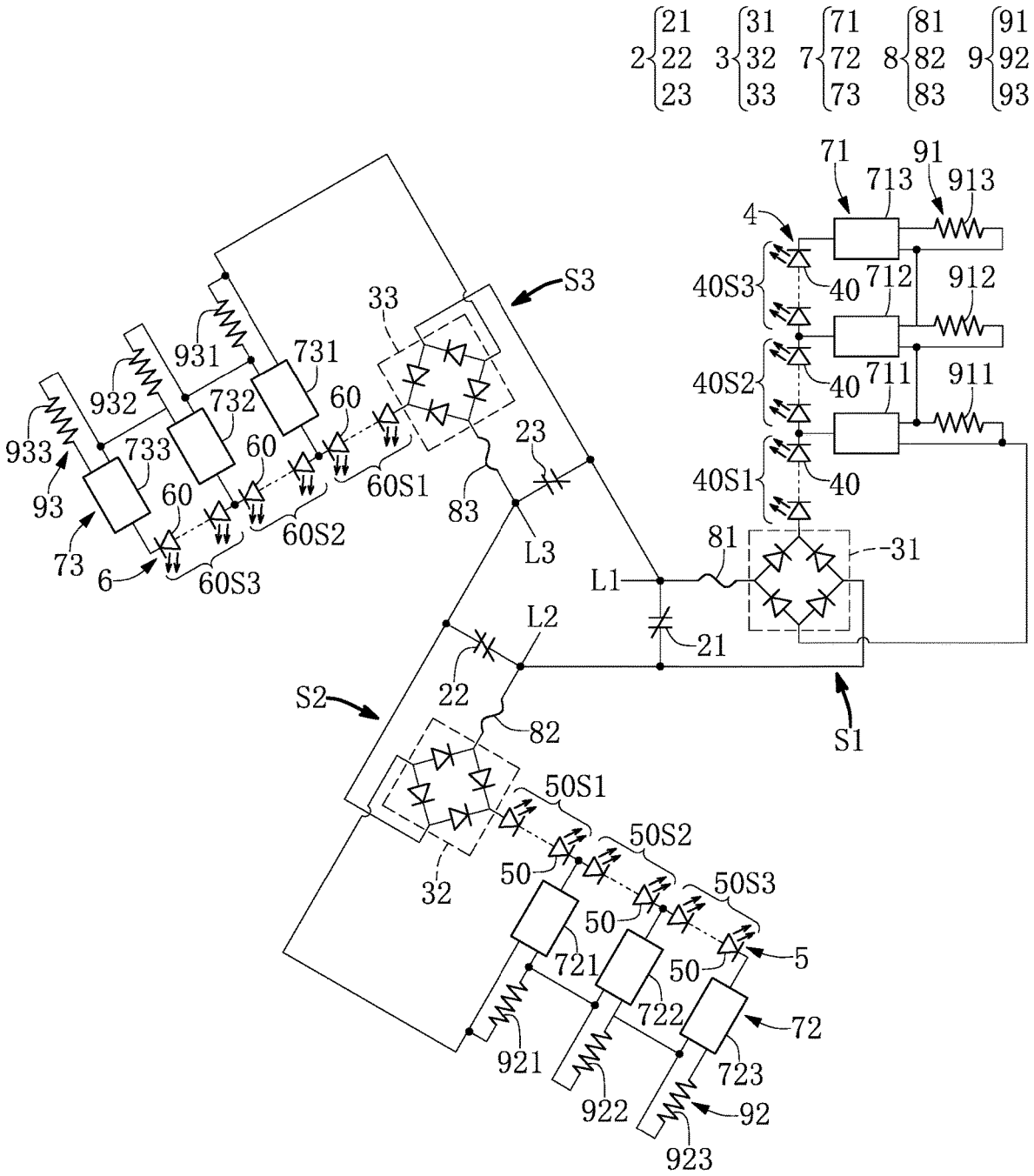
FIG. 6 is a schematic circuit diagram of the LED illuminating device according to the second embodiment of the present disclosure.

Referring to FIG. 5 and FIG. 6, a second embodiment of the present disclosure provides an LED illuminating device without using a capacitor, which at least includes a circuit substrate 1, a surge absorber group 2, a bridge rectifier group 3, a first LED chip group 4, a second LED chip group 5, a third LED chip group 6 and a current-limiting chip group 7. Comparing FIG. 5 with FIG. 1, and comparing FIG. 6 with FIG. 2, the main difference between the second embodiment and the first embodiment is as follows: in the second embodiment, the resistor chip group 9 includes a plurality of first resistor chips 91, a plurality of second resistor chips 92 and a plurality of third resistor chips 93, and the current-limiting chip group 7 includes a plurality of first current-limiting chips 71, a plurality of second current-limiting chips 72 and a plurality of third current-limiting chips 73.

More particularly, referring to FIG. 5 and FIG. 6, the first current-limiting chips 71 are electrically connected between the first LED chip group 4 and the first bridge rectifier 31, and the first current-limiting chips 71 are arranged in parallel with each other. The second current-limiting chips 72 are electrically connected between the second LED chip group 5 and the second bridge rectifier 32, and the second current-limiting chips 72 are arranged in parallel with each other. The third current-limiting chips 73 is electrically connected between the third LED chip group 6 and the third bridge rectifier 33, and the third current-limiting chips 73 are arranged in parallel with each other.

More particularly, referring to FIG. 5 and FIG. 6, the first LED chips 40 of the first LED chip group 4 can be divided into a first LED chip section 40S1 including at least two of the first LED chips 40 arranged in series, a second LED chip section 40S2 including at least another two of the first LED chips 40 arranged in series, and a third LED chip section 40S3 including at least yet another two of the first LED chips 40 arranged in series, and the first LED chip section 40S1, the second LED chip section 40S2 and the third LED chip section 40S3 of the first LED chip group 4 are arranged in series. Moreover, one of the first current-limiting chips 711 is electrically connected in parallel between the first LED chip section 40S1 and the second LED chip section 40S2 of the first LED chip group 4, another one of the first current-limiting chips 712 is electrically connected in parallel between the second LED chip section 40S2 and the third LED chip section 40S3 of the first LED chip group 4, and yet another one of the first current-limiting chips 713 is electrically connected in series to the third LED chip section 40S3 of the first LED chip group 4. It should be noted that the first resistor chips (911, 912, 913) are respectively electrically connected to the first current-limiting chips (711, 712, 713) for setting the current-limiting values of the first current-limiting chips 71.

More particularly, referring to FIG. 5 and FIG. 6, the second LED chips 50 of the second LED chip group 5 can be divided into a first LED chip section 50S1 including at least two of the second LED chips 50 arranged in series, a second LED chip section 50S2 including at least another two of the second LED chips 50 arranged in series, and a third LED chip section 50S3 including at least yet another two of the second LED chips 50 arranged in series, and the first LED chip section 50S1, the second LED chip section 50S2 and the third LED chip section 50S3 of the second LED chip group 5 are arranged in series. Moreover, one of the second current-limiting chips 721 is electrically connected in parallel between the first LED chip section 50S1 and the second LED chip section 50S2 of the second LED chip group 5, another one of the second current-limiting chips 722 is electrically connected in parallel between the second LED chip section 50S2 and the third LED chip section 50S3 of the second LED chip group 5, and yet another one of the second current-limiting chips 723 is electrically connected in series to the third LED chip section 50S3 of the second LED chip group 5. It should be noted that the second resistor chips (921, 922, 923) are respectively electrically connected to the second current-limiting chips (721, 722, 723) for setting the current-limiting values of the second current-limiting chips 72.

More particularly, referring to FIG. 5 and FIG. 6, the third LED chips 60 of the third LED chip group 6 can be divided into a first LED chip section 60S1 including at least two of the third LED chips 60 arranged in series, a second LED chip section 60S2 including at least another two of the third LED chips 60 arranged in series, and a third LED chip section 60S3 including at least yet another two of the third LED chips 60 arranged in series, and the first LED chip section 60S1, the second LED chip section 60S2 and the third LED chip section 60S3 of the third LED chip group 6 are arranged in series. Moreover, one of the third current-limiting chips 731 is electrically connected in parallel between the first LED chip section 60S1 and the second LED chip section 60S2 of the third LED chip group 6, another one of the third current-limiting chips 732 is electrically connected in parallel between the second LED chip section 60S2 and the third LED chip section 60S3 of the third LED chip group 6, and yet another one of the third current-limiting chips 733 is electrically connected in series to the third LED chip section 60S3 of the third LED chip group 6. It should be noted that the third resistor chips (931, 932, 933) are respectively electrically connected to the third current-limiting chips (731, 732, 733) for setting the current-limiting values of the third current-limiting chips 73.

It should be noted that as shown in FIG. 5 and FIG. 6, the first current-limiting chip 711 is configured to limit the maximum current of the first LED chip section 40S1 of the first LED chip group 4, the second current-limiting chip 721 is configured to limit the maximum current of the first LED chip section 50S1 of the second LED chip group 5, and the third current-limiting chip 731 is configured to limit the maximum current of the first LED wafer section 60S1 of the third LED chip group 6. Furthermore, when the voltage is increased, the first current-limiting chip 711, the second current-limiting chip 721 and the third current-limiting chip 731 can be used as switches to turn on the second LED chip section 40S2 of the first LED chip group 4, the second LED chip section 50S2 of the second LED chip group 5 and the second LED chip section 60S2 of the third LED chip group 6, respectively.

It should be noted that, as shown in FIG. 5 and FIG. 6, the first current-limiting chip 712 is configured to limit the maximum current of the first LED chip section 40S1 and the second LED chip section 40S2 of the first LED chip group 4, the second current-limiting chip 722 is configured to limit the maximum current of the first LED chip section 50S1 and the second LED chip section 50S2 of the second LED chip group 5, and the third current-limiting chip 732 is configured to limit the maximum current of the first LED chip section 60S1 and the second LED chip section 60S2 of the third LED chip group 6. Furthermore, when the voltage is increased, the first current-limiting chip 712, the second current-limiting chip 722 and the third current-limiting chip 732 can be used as switches to turn on the third LED chip section 40S3 of the first LED chip group 4, the third LED chip section 50S3 of the second LED chip group 5 and the third LED chip section 60S3 of the third LED chip group 6, respectively.

It should be noted that, as shown in FIG. 5 and FIG. 6, the first current-limiting chip 713 is configured to limit the maximum current of the first LED chip section 40S1, the second LED chip section 40S2 and the third LED chip section 40S3 of the first LED chip group 4, and can provide a surge protection of at least 500V. Furthermore, the second current-limiting chip 723 is configured to limit the maximum current of the first LED chip section 50S1, the second LED chip section 50S2 and the third LED chip section 50S3 of the second LED chip group 5, and can provide a surge protection of at least 500V. In addition, the third current-limiting chip 733 is configured to limit the maximum current of the first LED chip section 60S1, the second LED chip section 60S2 and the third LED chip section 60S3 of the third LED chip group 6, and can provide a surge protection of at least 500V.

Figure 7:
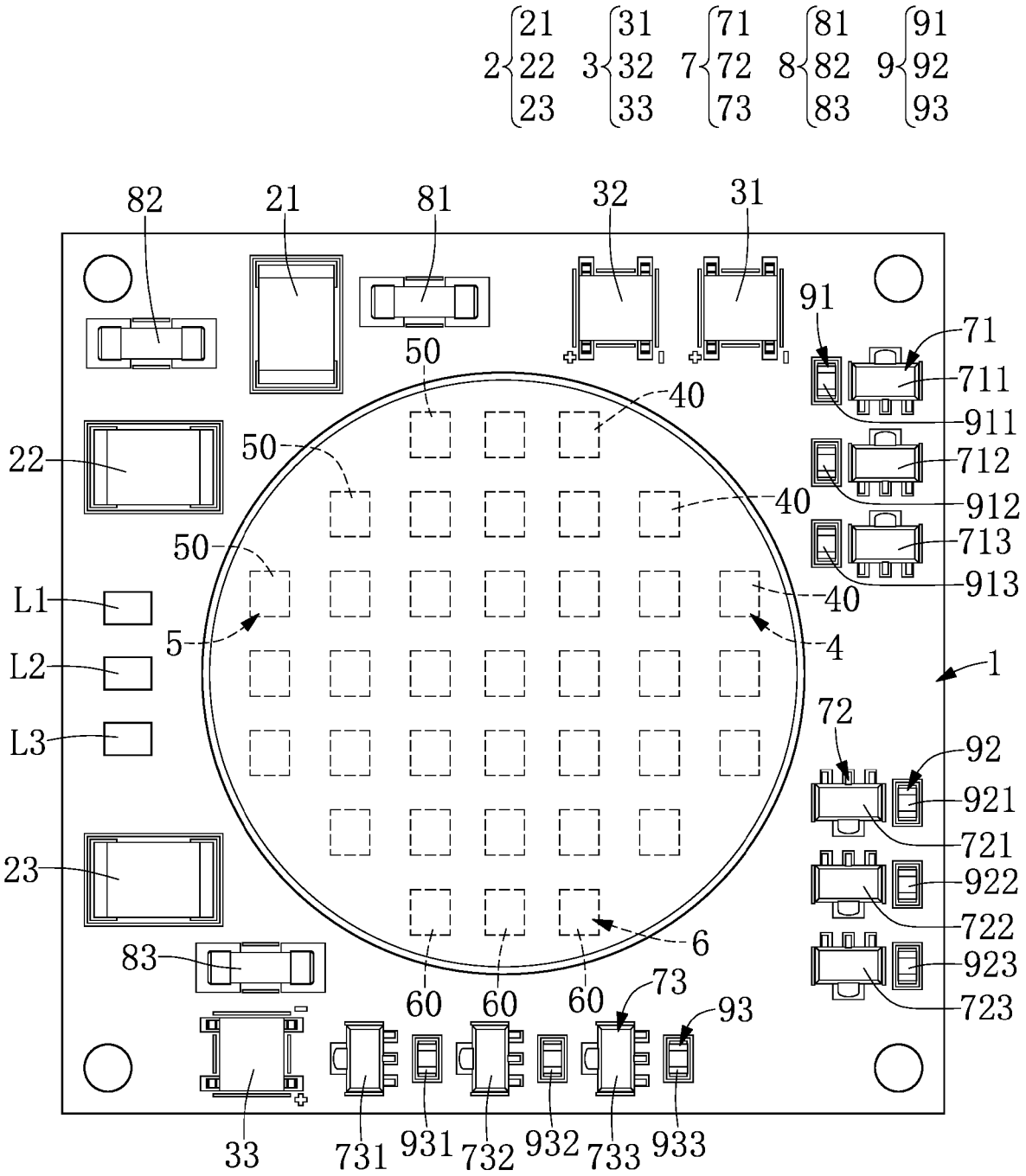
FIG. 7 is a schematic top view of another LED illuminating device according to the second embodiment of the present disclosure (when the first LED chips, the second LED chips and the third LED chips are electrically connected to the circuit substrate by COB)

It should be noted that, for example, as shown in FIG. 7, the second embodiment of the present disclosure further provides another LED illuminating device, and the first LED chips 40, the second LED chips 50 and the third LED chips 60 can be electrically connected to the circuit substrate 1 by means of chip on board (COB). That is to say, when the LED chip is a bare die and has not been packaged, the bare LED chip can be electrically connected to the circuit substrate 1 by COB, and then the bare LED chip can be covered with a light-transmitting protective layer or a fluorescent layer. However, the aforementioned details are disclosed for exemplary purposes only, and are not meant to limit the scope of the present disclosure.

Third Embodiment

Figure 8:
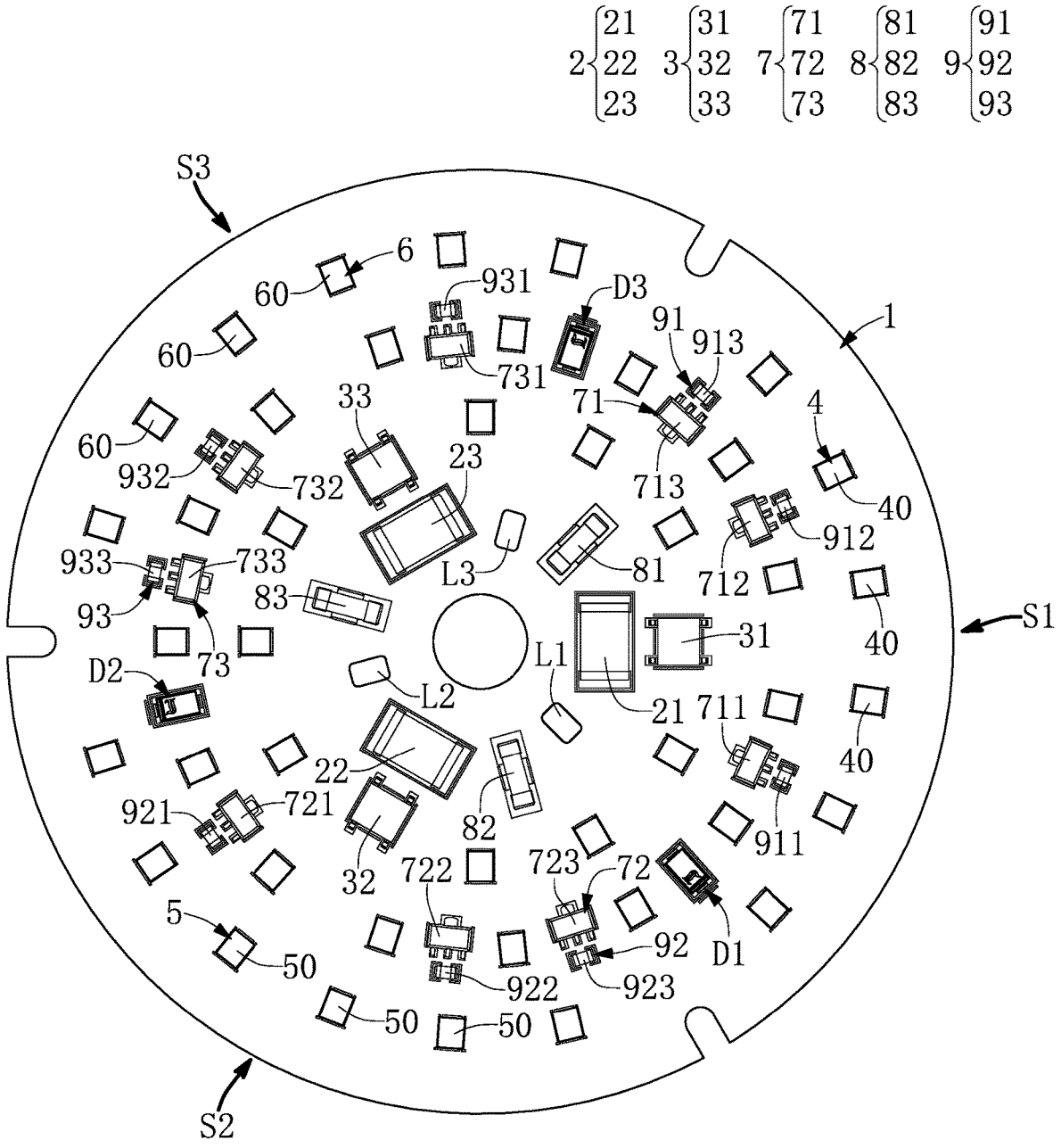
FIG. 8 is a schematic top view of the LED illuminating device according to a third embodiment of the present disclosure (when the first LED chips, the second LED chips and the third LED chips are electrically connected to the circuit substrate by SMT)
Figure 9:
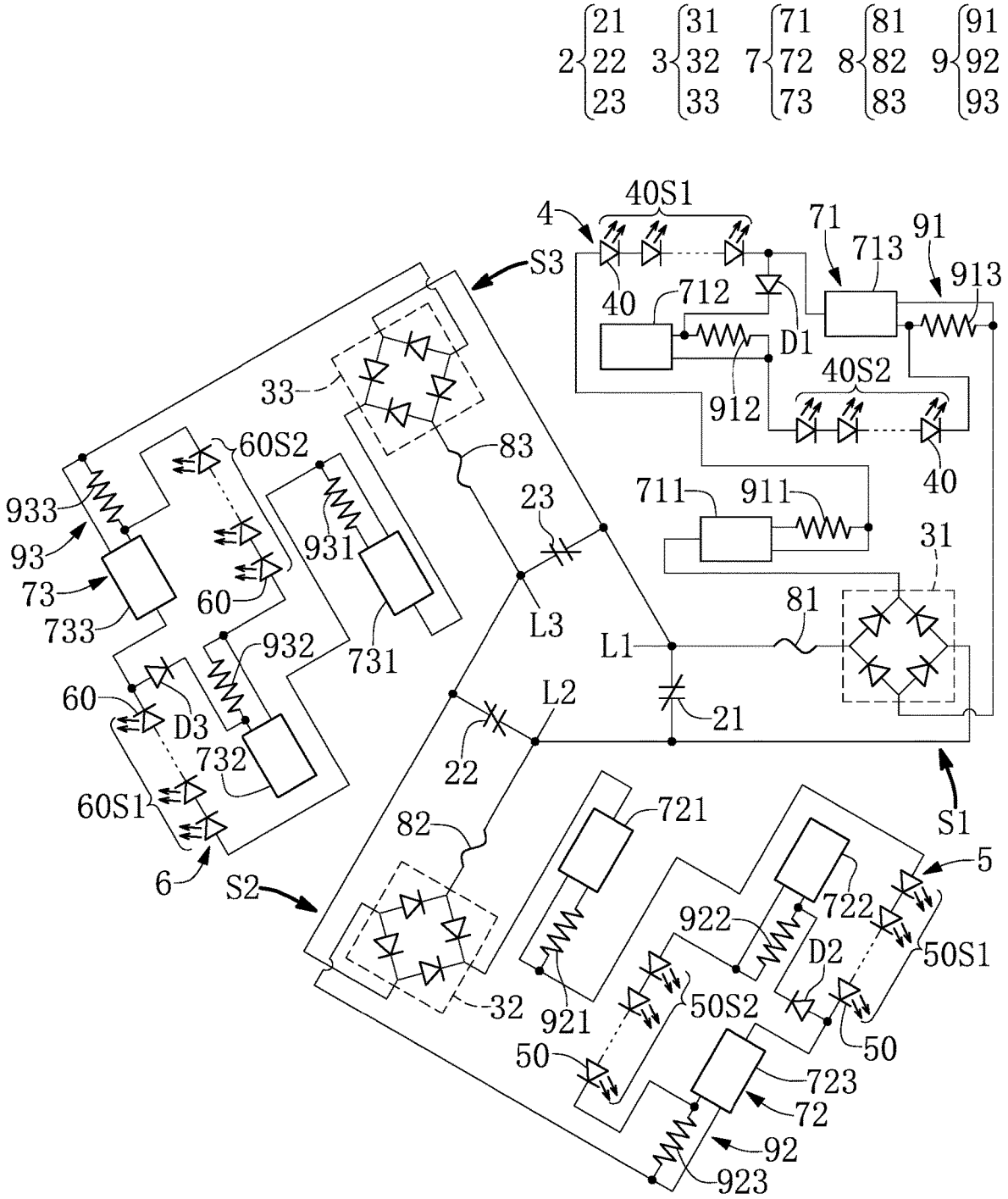
FIG. 9 is a schematic circuit diagram of the LED illuminating device according to the third embodiment of the present disclosure.

Referring to FIG. 8 and FIG. 9, a third embodiment of the present disclosure provides an LED illuminating device without using a capacitor, which at least includes a circuit substrate 1, a surge absorber group 2, a bridge rectifier group 3, a first LED chip group 4, a second LED chip group 5, a third LED chip group 6 and a current-limiting chip group 7. Comparing FIG. 8 with FIG. 5, and comparing FIG. 9 with FIG. 6, the main difference between the third embodiment and the second embodiment is as follows.

In the third embodiment, as shown in FIG. 8 and FIG. 9, the first LED chips 40 of the first LED chip group 4 can be divided into a first LED chip section 40S1 including at least two of the first LED chips 40 arranged in series, and a second LED chip section 40S2 including at least another two of the first LED chips 40 arranged in series, the first LED chip section 40S1 and the second LED chip section 40S2 of the first LED chip group 4 are arranged in parallel, and the first LED chip section 40S1 and the second LED chip section 40S2 of the first LED chip group 4 can be electrically connected with each other through a first unidirectional conduction chip D1 (such as a first one-way conduction chip). Moreover, one of the first current-limiting chips 711 is electrically connected in series to the first LED chip section 40S1 of the first LED chip group 4, another one of the first current-limiting chips 712 is electrically connected in parallel to the first LED chip section 40S1 of the first LED chip group 4, and yet another one of the first current-limiting chips 713 is electrically connected in parallel to the second LED chip section 40S2 of the first LED chip group 4.

In the third embodiment, as shown in FIG. 8 and FIG. 9, the second LED chips 50 of the second LED chip group 5 can be divided into a first LED chip section 50S1 including at least two of the second LED chips 50 arranged in series, and a second LED chip section 50S2 including at least another two of the second LED chips 50 arranged in series, the first LED chip section 50S1 and the second LED chip section 50S2 of the second LED chip group 5 are arranged in parallel, and the first LED chip section 50S1 and the second LED chip section 50S2 of the second LED chip group 5 can be electrically connected with each other through a second unidirectional conduction chip D2 (such as a second one-way conduction chip). Moreover, one of the second current-limiting chips 721 is electrically connected in series to the first LED chip section 50S1 of the second LED chip group 5, another one of the second current-limiting chips 722 is electrically connected in parallel to the first LED chip section 5051 of the second LED chip group 5, and yet another one of the second current-limiting chips 723 is electrically connected in parallel to the second LED chip section 5052 of the second LED chip group 5.

In the third embodiment, as shown in FIG. 8 and FIG. 9, the third LED chips 60 of the third LED chip group 6 can be divided into a first LED chip section 60S1 including at least two of the third LED chips 60 arranged in series, and a second LED chip section 6052 including at least another two of the third LED chips 60 arranged in series, the first LED chip section 60S1 and the second LED chip section 6052 of the third LED chip group 6 are arranged in parallel, and the first LED chip section 60S1 and the second LED chip section 6052 of the third LED chip group 6 can be electrically connected with each other through a third unidirectional conduction chip D3 (such as a third one-way conduction chip). Moreover, one of the third current-limiting chips 731 is electrically connected in series to the first LED chip section 60S1 of the third LED chip group 6, another one of the third current-limiting chips 732 is electrically connected in parallel to the first LED chip section 60S1 of the third LED chip group 6, and yet another one of the third current-limiting chips 733 is electrically connected in parallel to the second LED chip section 60S2 of the third LED chip group 6.

It should be noted that as shown in FIG. 8 and FIG. 9, the first current-limiting chip 711 is configured to limit the maximum current when the first LED chip section 40S1 and the second LED chip section 40S2 of the first LED chip group 4 are connected in series, and can provide a surge protection of at least 500V. Furthermore, the second current-limiting chip 721 is configured to limit the maximum current when the first LED chip section 50S1 and the second LED chip section 50S2 of the second LED chip group 5 are connected in series, and can provide a surge protection of at least 500V. In addition, the third current-limiting chip 731 is configured to limit the maximum current when the first LED chip section 60S1 and the second LED chip section 60S2 of the third LED chip group 6 are connected in series, and can provide a surge protection of at least 500V.

It should be noted that as shown in FIG. 8 and FIG. 9, the first current-limiting chip 712 and the first current-limiting chip 713 are configured to limit the maximum current when the first LED chip section 40S1 and the second LED chip section 40S2 of the first LED chip group 4 are connected in parallel, and the first current-limiting chip 712 and the first current-limiting chip 713 can be used as switches to serially connect the first LED chip section 40S1 and the second LED chip section 40S2 of the second LED chip group 4 when the voltage is increased. Furthermore, the second current-limiting chip 722 and the second current-limiting chip 723 are configured to limit the maximum current when the first LED chip section 50S1 and the second LED chip section 50S2 of the second LED chip group 5 are connected in parallel, and the second current-limiting chip 722 and the second current-limiting chip 723 can be used as switches to serially connect the first LED chip section 50S1 and the second LED chip section 50S2 of the second LED chip group 5 when the voltage increases. In addition, the third current-limiting chip 732 and the third current-limiting chip 733 are configured to limit the maximum current when the first LED chip section 60S1 and the second LED chip section 60S2 of the third LED chip group 6 are connected in parallel, and the third current-limiting chip 732 and the third current-limiting chip 733 can be used as switches to serially connect the first LED chip section 60S1 and the second LED chip section 60S2 of the third LED chip group 6 when the voltage increases.

It should be noted that as shown in FIG. 8 and FIG. 9, the first unidirectional conduction chip D1 can be configured to limit the current direction, so that the first LED chip section 40S1 and the second LED chip section 40S2 of the first LED chip group 4 can be connected in parallel through the first unidirectional conduction chip D1. Furthermore, the second unidirectional conduction chip D2 can be configured to limit the current direction, so that the first LED chip section 50S1 and the second LED chip section 50S2 of the second LED chip group 5 can be connected in parallel through the second unidirectional conduction chip D2. In addition, the third unidirectional conduction chip D3 can be configured to limit the current direction, so that the first LED chip section 60S1 and the second LED chip section 60S2 of the third LED chip group 6 can be connected in parallel through the third unidirectional conduction chip D3.

Figure 10:
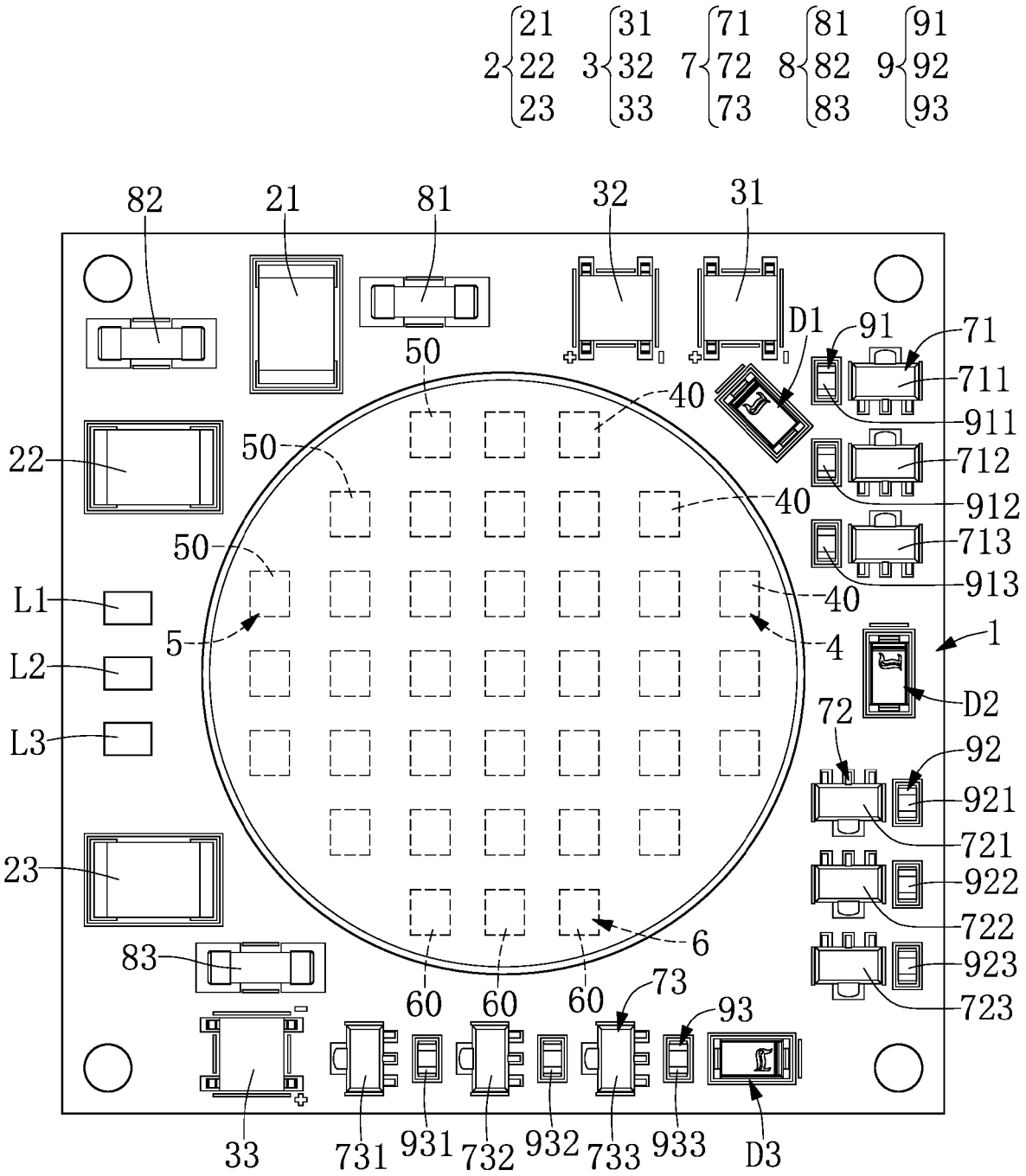
FIG. 10 is a schematic top view of another LED illuminating device according to the third embodiment of the present disclosure (when the first LED chips, the second LED chips and the third LED chips are electrically connected to the circuit substrate by COB)

It should be noted that, for example, as shown in FIG. 10, the third embodiment of the present disclosure further provides another LED illuminating device, and the first LED chips 40, the second LED chips 50 and the third LED chips 60 can be electrically connected to the circuit substrate 1 by means of chip on board (COB). That is to say, when the LED chip is a bare die and has not been packaged, the bare LED chip can be electrically connected to the circuit substrate 1 by COB, and then the bare LED chip can be covered with a light-transmitting protective layer or a fluorescent layer. However, the aforementioned details are disclosed for exemplary purposes only, and are not meant to limit the scope of the present disclosure.

Fourth Embodiment

Figure 11:
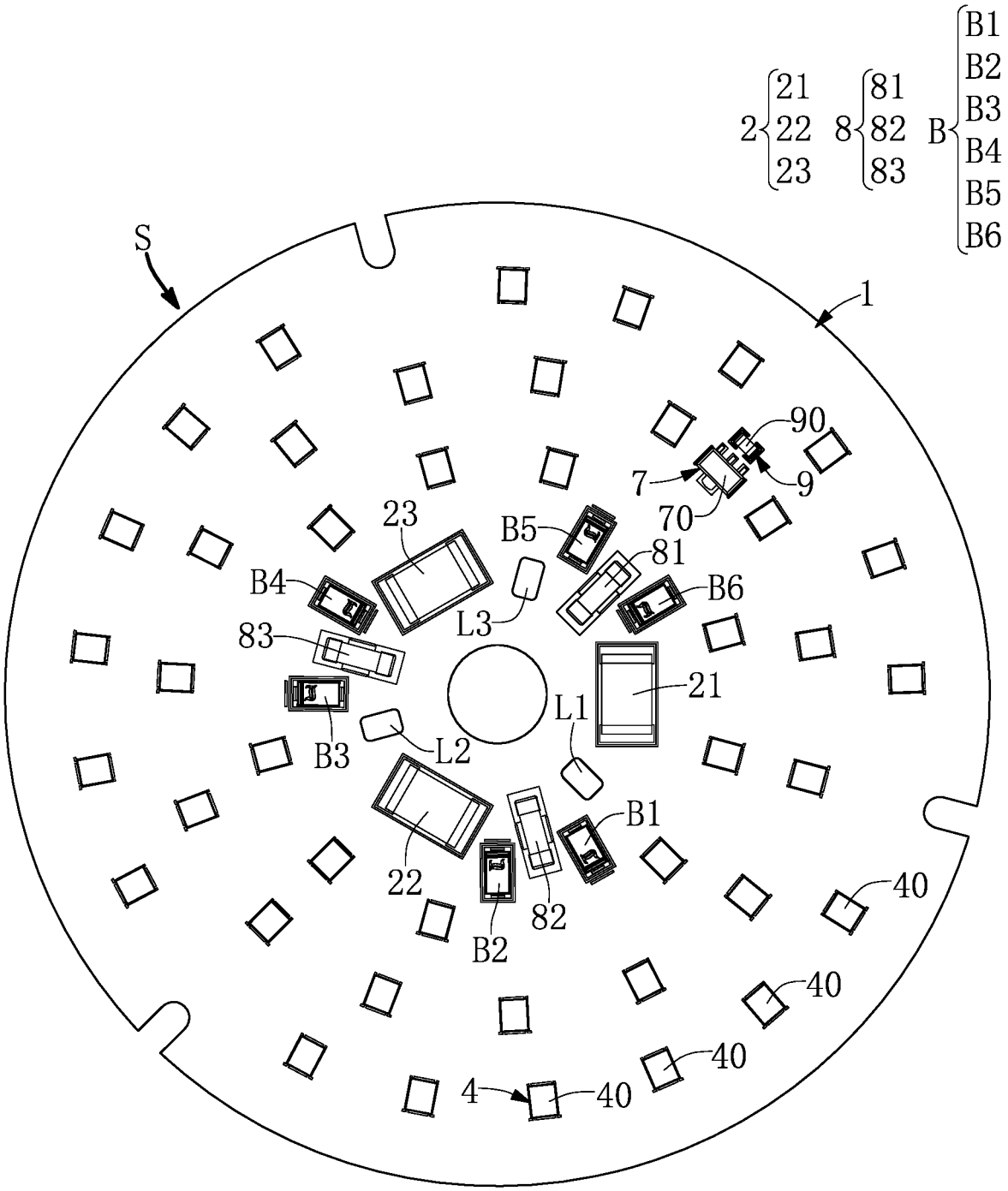
FIG. 11 is a schematic top view of the LED illuminating device according to a fourth embodiment of the present disclosure (when a plurality of LED chips are electrically connected to the circuit substrate by SMT)
Figure 12:
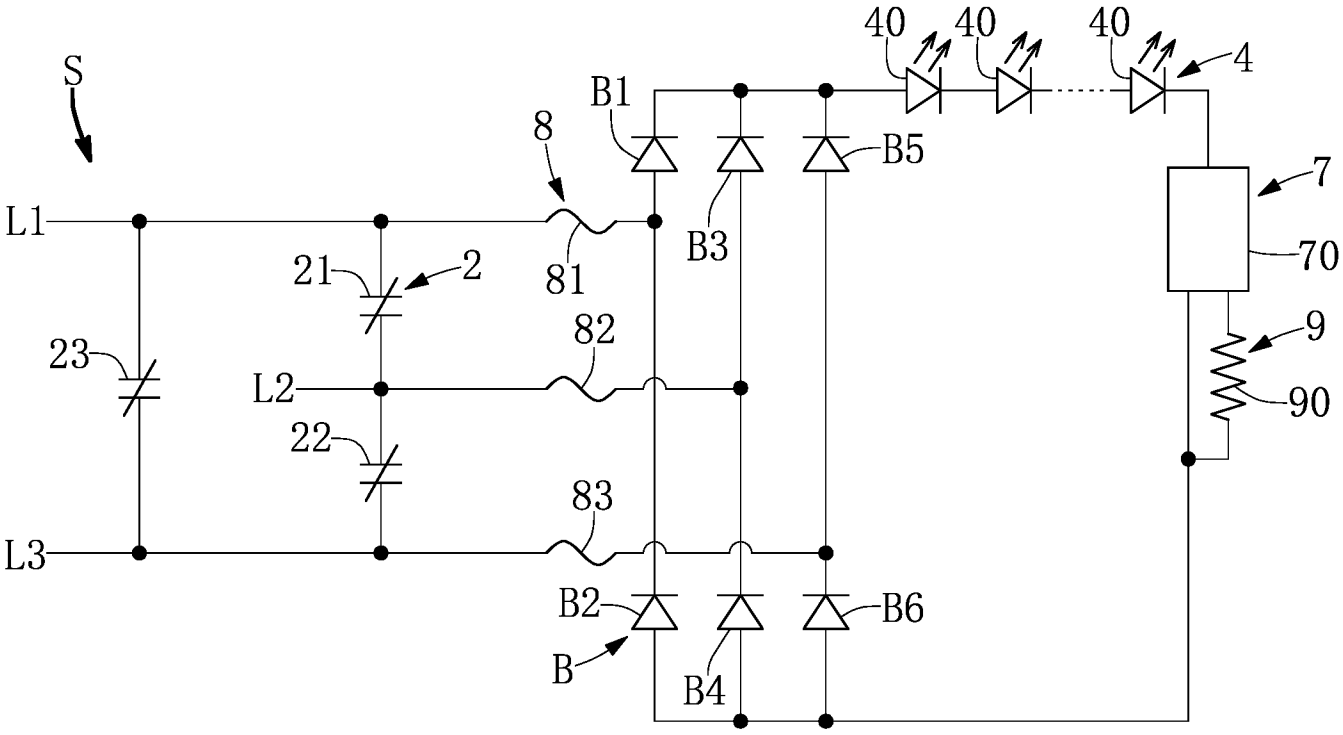
FIG. 12 is a schematic circuit diagram of the LED illuminating device according to the fourth embodiment of the present disclosure.
Figure 13:
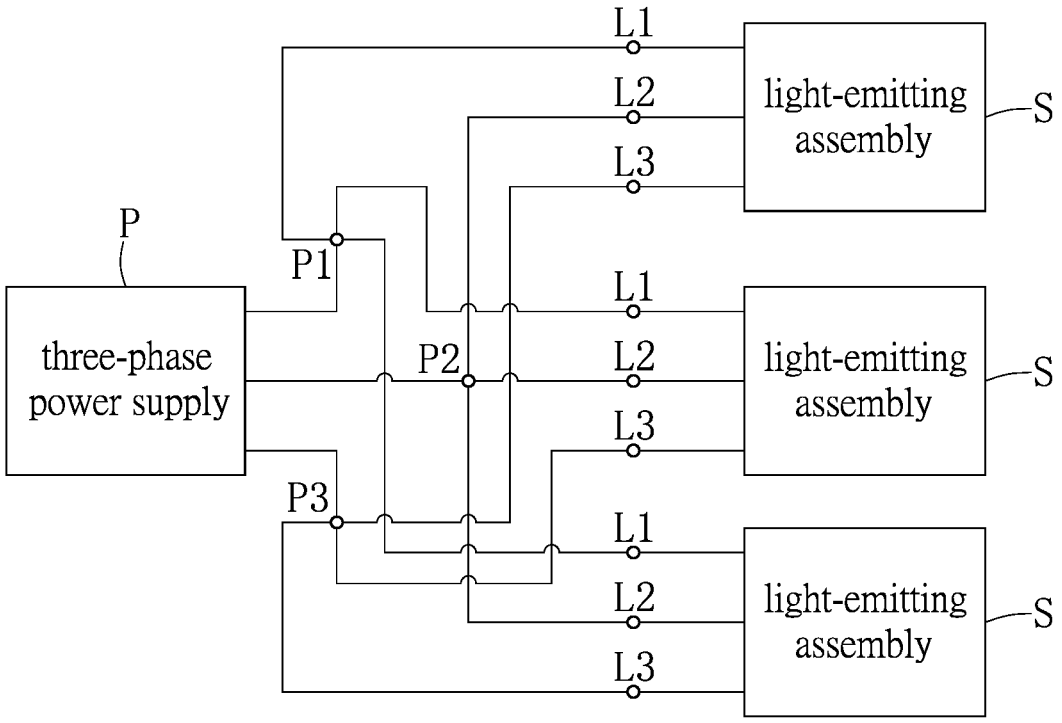
FIG. 13 is a functional block diagram of the LED illuminating device being electrically connected to the three-phase power supply according to the fourth embodiment of the present disclosure.

Referring to FIG. 11 to FIG. 13, a fourth embodiment of the present disclosure provides an LED illuminating device without using a capacitor, which at least includes a circuit substrate 1, a surge absorber group 2, a three-phase rectifier bridge module B, an LED chip group 4 and a current-limiting chip group 7.

Firstly, referring to FIG. 11 and FIG. 13, there is not any capacitor disposed on the circuit substrate 1, and the circuit substrate 1 includes a first AC power input terminal L1, a second AC power input terminal L2 and a third AC power input terminal L3 that are electrically connected to a three-phase power supply P. For example, the circuit substrate 1 may be any kind of circuit board, and the three-phase power supply P includes a first AC power output terminal P1, a second AC power output terminal P2 and a third AC power output terminal P3 electrically connected to the first AC power input terminal L1, the second AC power input terminal L2 and the third AC power input terminal L3 of the circuit substrate 1, respectively. However, the aforementioned details are disclosed for exemplary purposes only, and are not meant to limit the scope of the present disclosure.

Moreover, referring to FIG. 11 and FIG. 12, the surge absorber group 2 is disposed on the circuit substrate 1 and electrically connected to the circuit substrate 1, and the surge absorber group 2 includes a first surge absorber 21 (or a first anti-surge device, or a first varistor), a second surge absorber 22 (or a first anti-surge device, or a first varistor), and a third surge absorber 23 (or a first anti-surge device, or a first varistor) for absorbing a surge voltage (or a voltage of a voltage surge). More particularly, the first surge absorber 21 is electrically connected between the first AC power input terminal L1 and the second AC power input terminal L2 to serve as a first surge protection between the first AC power input terminal L1 and the second AC power input terminal L2. The second surge absorber 22 is electrically connected between the second AC power input terminal L2 and the third AC power input terminal L3 to serve as a second surge protection between the second AC power input terminal L2 and the third AC power input terminal L3. The third surge absorber 23 is electrically connected between the third AC power input terminal L3 and the first AC power input terminal L1 to serve as a third surge protection between the third AC power input terminal L3 and the first AC power input terminal L1.

Furthermore, referring to FIG. 11 and FIG. 12, the three-phase rectifier bridge module B is disposed on the circuit substrate 1 and electrically connected to the circuit substrate 1, and the three-phase rectifier bridge module B is electrically connected to the first AC power input terminal L1, the second AC power input terminal L2 and the third AC power input terminal L3 for converting the alternating current (AC) provided by the three-phase power supply P into the direct current (DC). For example, the three-phase rectifier bridge module B includes a first electronic component B1, a second electronic component B2, a third electronic component B3, a fourth electronic component B4, a fifth electronic component B5 and a sixth electronic component B6, and the first electronic component B1, the second electronic component B2, the third electronic component B3, the fourth electronic component B4, the fifth electronic component B5 and the sixth electronic component B6 are diodes. Moreover, the first AC power input terminal L1 is electrically connected to the first electronic component B1 and the second electronic component B2, the second AC power input terminal L2 is electrically connected to the third electronic component B3 and the fourth electronic component B4, and the third AC power input terminal L3 is electrically connected to the fifth electronic component B5 and the sixth electronic component B6. However, the aforementioned details are disclosed for exemplary purposes only, and are not meant to limit the scope of the present disclosure.

In addition, referring to FIG. 11 and FIG. 12, the LED chip group 4 is disposed on the circuit substrate 1 and electrically connected to the circuit substrate 1, the LED chip group 4 is electrically connected to the three-phase rectifier bridge module B, and the LED chip group 4 includes a plurality of LED chips 40. For example, the LED chips 40 can be used to provide light sources having the same or different wavelengths. In addition, the LED chips 40 can be electrically connected to the circuit substrate 1 by means of surface mount technology (SMT). That is to say, when the LED chip has been packaged, the packaged LED chip can be electrically connected to the circuit substrate 1 by SMT. However, the aforementioned details are disclosed for exemplary purposes only, and are not meant to limit the scope of the present disclosure.

Moreover, referring to FIG. 11 and FIG. 12, the current-limiting chip group 7 is disposed on the circuit substrate 1 and electrically connected to the circuit substrate 1, and the current-limiting chip group 7 is electrically connected to the three-phase rectifier bridge module B. More particularly, the current-limiting chip group 7 includes a current-limiting chip 70 electrically connected between the LED chip group 4 and the three-phase rectifier bridge module B for limiting the maximum current of the LED illuminating device and providing surge protection of at least 500V.

It should be noted that referring to FIG. 11 and FIG. 12, the LED illuminating device provided by the fourth embodiment of the present disclosure further includes a fuse chip group 8 and a resistor chip group 9. More particularly, the fuse chip group 8 is disposed on the circuit substrate 1 and electrically connected to the circuit substrate 1, and the fuse chip group 8 includes a first fuse chip 81, a second fuse chip 82 and a third fuse chip 83 for providing current overload protection. The first fuse chip 81 is electrically connected to the first AC power input terminal L1 and the three-phase rectifier bridge module B to provide current overload protection for the first AC power input terminal L1. The second fuse chip 82 is electrically connected between the second AC power input terminal L2 and the three-phase rectifier bridge module B to provide current overload protection for the second AC power input terminal L2. The third fuse chip 83 is electrically connected between the third AC power input terminal L3 and the three-phase rectifier bridge module B to provide current overload protection for the third AC power input terminal L3. Moreover, the resistor chip group 9 is disposed on the circuit substrate 1 and electrically connected to the circuit substrate 1, and the resistor chip group 9 includes a resistor chip 90 electrically connected to the current-limiting chip 70 for setting the current-limiting value of the current-limiting chip 70 of the current-limiting chip group 7.

For example, referring to FIG. 11 and FIG. 12, the LED chips 40 of the LED chip group 4 are electrically connected in series between the three-phase rectifier bridge module B and the current-limiting chip 70. However, the aforementioned details are disclosed for exemplary purposes only, and are not meant to limit the scope of the present disclosure.

It should be noted that referring to FIG. 11 to FIG. 13, the first surge absorber 21, the second surge absorber 22, the third surge absorber 23, the first fuse chip 81, the second fuse chip 82, the third fuse chip 83, the three-phase rectifier bridge module B, the LED chip group 4, the current-limiting chip 70 and the resistor chip 90 can cooperate with each other to form a light-emitting assembly S (such as a three-phase light source having a first AC power input terminal L1, a second AC power input terminal L2 and a third AC power input terminal L3). Moreover, as shown in FIG. 13, the three light-emitting assembles S serving as the three three-phase light sources have been load balanced (have completed load balancing), and can be electrically connected to the first AC power output terminal P1, the second AC power output terminal P2 and the third AC power output terminal P3 of the three-phase power supply P in parallel.

Figure 14:
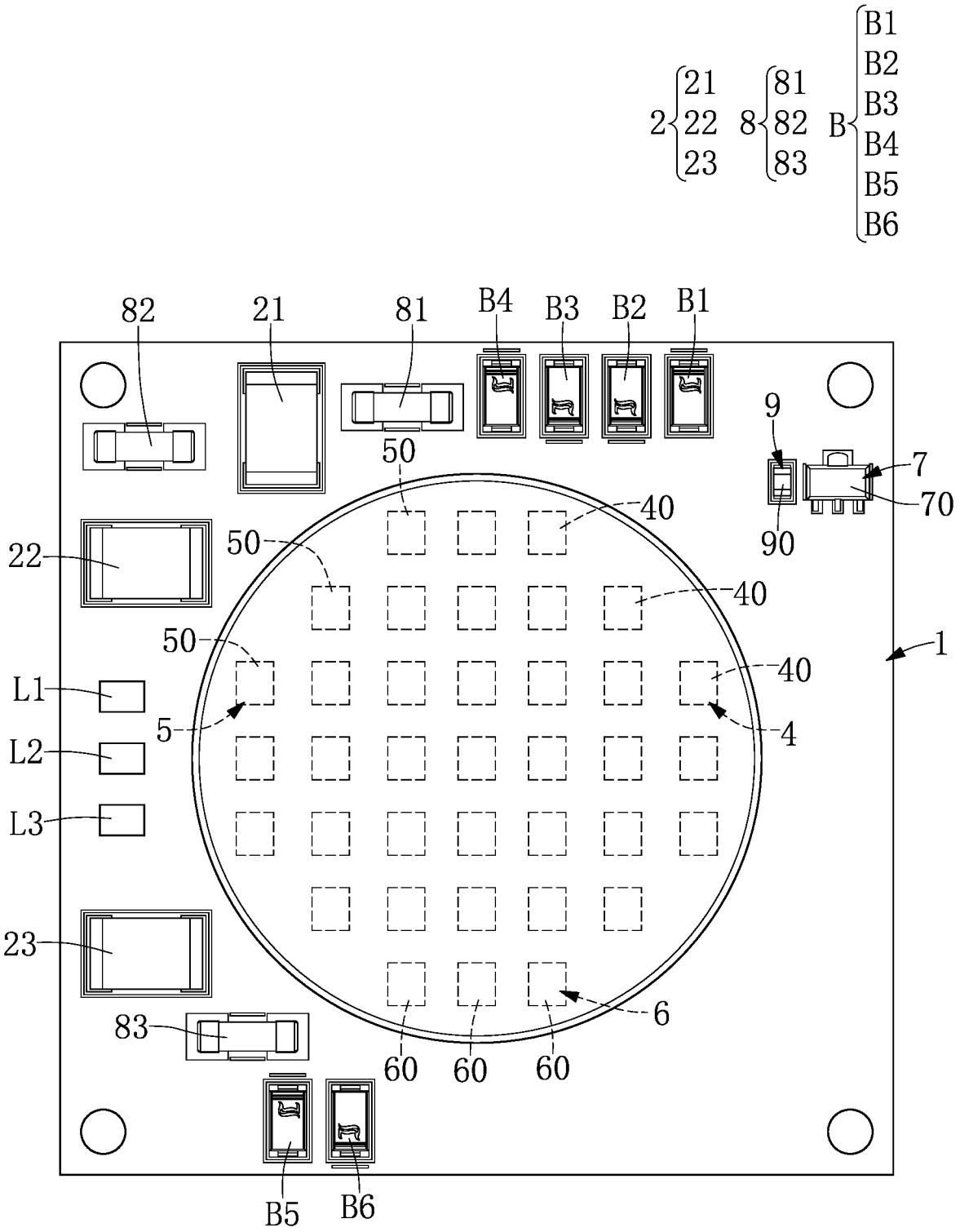
FIG. 14 is a schematic top view of another LED illuminating device according to the fourth embodiment of the present disclosure (when the LED chips are electrically connected to the circuit substrate by COB)

It should be noted that, for example, as shown in FIG. 14, the fourth embodiment of the present disclosure further provides another LED illuminating device, and the LED chips 40 can be electrically connected to the circuit substrate 1 by means of chip on board (COB). That is to say, when the LED chip 40 is a bare die and has not been packaged, the bare LED chip 40 can be electrically connected to the circuit substrate 1 by COB, and then the bare LED chip 40 can be covered with a light-transmitting protective layer or a fluorescent layer. However, the aforementioned details are disclosed for exemplary purposes only, and are not meant to limit the scope of the present disclosure.

Fifth Embodiment

Figure 15:
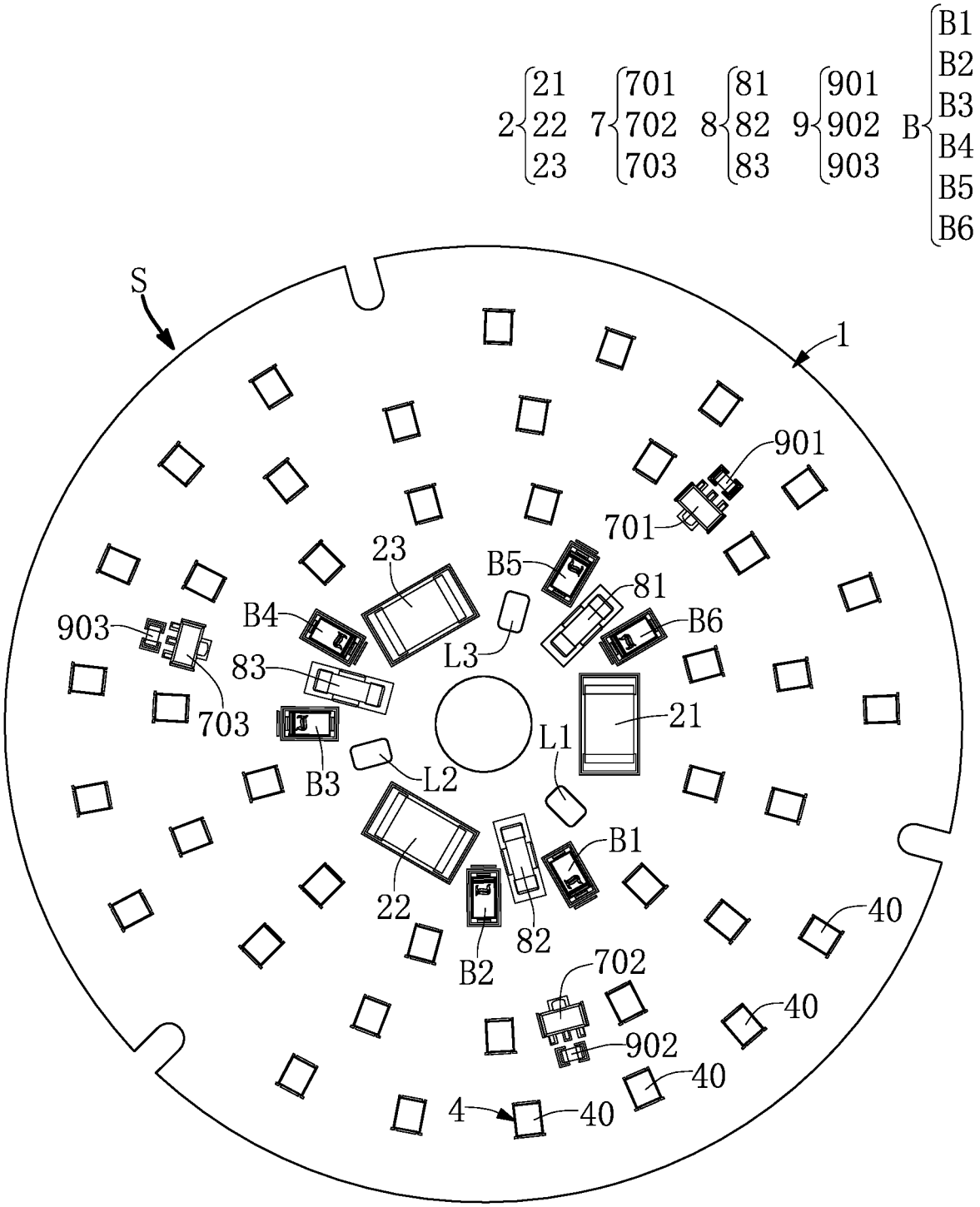
FIG. 15 is a schematic top view of the LED illuminating device according to a fifth embodiment of the present disclosure (when the LED chips are electrically connected to the circuit substrate by SMT)
Figure 16:
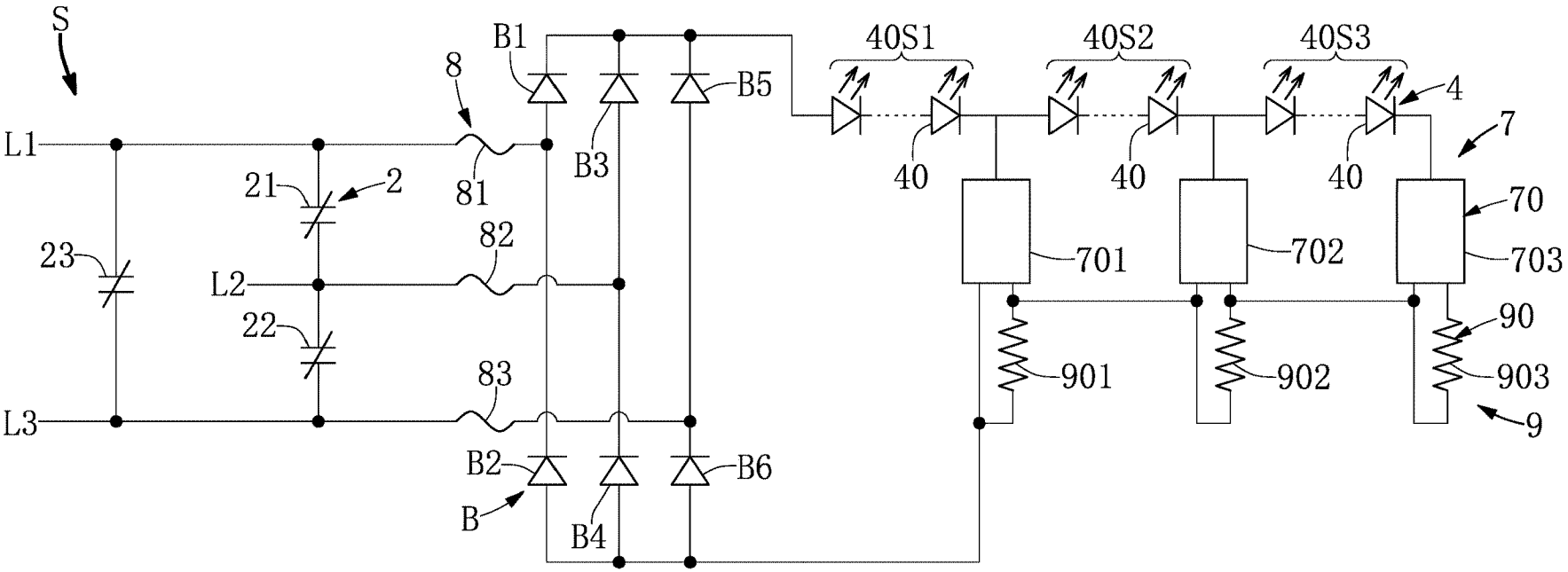
FIG. 16 is a schematic circuit diagram of the LED illuminating device according to the fifth embodiment of the present disclosure.

Referring to FIG. 15 and FIG. 16, a fifth embodiment of the present disclosure provides an LED illuminating device without using a capacitor, which at least includes a circuit substrate 1, a surge absorber group 2, a three-phase rectifier bridge module B, an LED chip group 4 and a current-limiting chip group 7. Comparing FIG. 15 with FIG. 11, and comparing FIG. 16 with FIG. 12, the main difference between the fifth embodiment and the fourth embodiment is as follows: in the fifth embodiment, the resistor chip group 9 includes a plurality of resistor chips 90, and the current-limiting chip group 7 includes a plurality of current-limiting chips 70. Moreover, the current-limiting chips 70 are electrically connected between the LED chip group 4 and the three-phase rectifier bridge module B, and the current-limiting chips 70 are arranged in parallel with each other.

More particularly, referring to FIG. 15 and FIG. 16, the LED chips 40 of the LED chip group 4 can be divided into a first LED chip section 40S1 including at least two of the LED chips 40 arranged in series, a second LED chip section 40S2 including at least another two of the LED chips 40 arranged in series, and a third LED chip section 40S3 including at least yet another two of the LED chips 40 arranged in series, and the first LED chip section 40S1, the second LED chip section 40S2 and the third LED chip section 40S3 of the LED chip group 4 are arranged in series. Moreover, one of the current-limiting chips 701 is electrically connected in parallel between the first LED chip section 40S1 and the second LED chip section 40S2 of the LED chip group 4, another one of the current-limiting chips 702 is electrically connected in parallel between the second LED chip section 40S2 and the third LED chip section 40S3 of the LED chip group 4, and yet another one of the current-limiting chips 703 is electrically connected in series to the third LED chip section 40S3 of the LED chip group 4. It should be noted that the resistor chips (901, 902, 903) are respectively electrically connected to the current-limiting chips (701, 702, 703) for setting the current-limiting values of the current-limiting chips 70.

It should be noted that as shown in FIG. 15 and FIG. 16, the current-limiting chip 701 is configured to limit the maximum current of the first LED chip section 40S1 of the LED chip group 4. When the voltage is increased, the current-limiting chip 701 can be used as a switch to turn on the second LED chip section 40S2 of the LED chip group 4. Moreover, the current-limiting chip 702 is configured to limit the maximum current of the first LED chip section 40S1 and the second LED chip section 40S2 of the LED chip group 4. When the voltage is increased, the current-limiting chip 702 can be used as a switch to turn on the third LED chip section 40S3 of the LED chip group 4. Furthermore, the current-limiting chip 703 is configured to limit the maximum current of the first LED chip section 40S1, the second LED chip section 40S2 and the third LED chip section 40S3 of the LED chip group 4, and can provide a surge protection of at least 500V.

Figure 17:
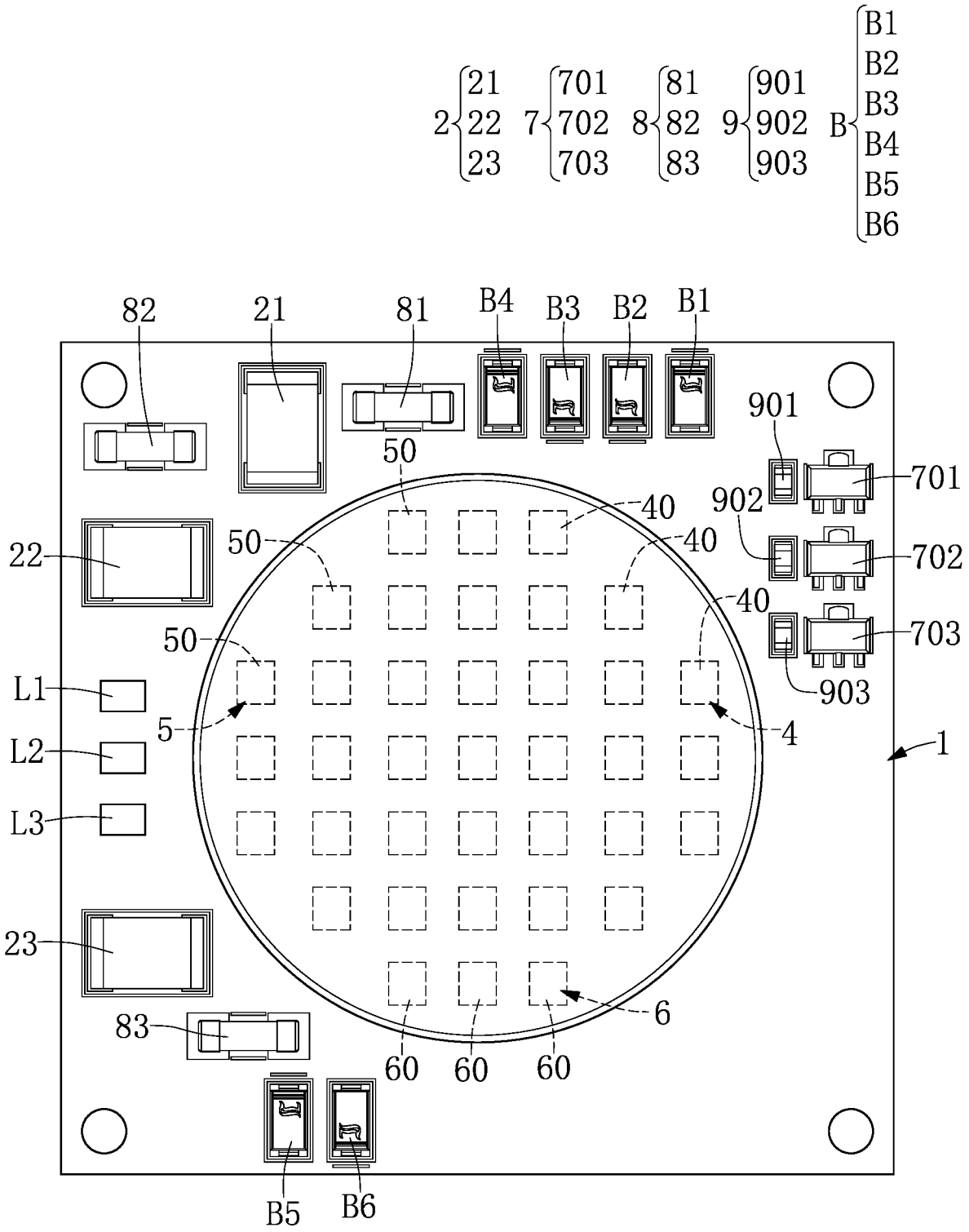
FIG. 17 is a schematic top view of another LED illuminating device according to the fifth embodiment of the present disclosure (when the LED chips are electrically connected to the circuit substrate by COB)

It should be noted that, for example, as shown in FIG. 17, the fifth embodiment of the present disclosure further provides another LED illuminating device, and the LED chips 40 can be electrically connected to the circuit substrate 1 by means of chip on board (COB). That is to say, when the LED chip 40 is a bare die and has not been packaged, the bare LED chip 40 can be electrically connected to the circuit substrate 1 by COB, and then the bare LED chip 40 can be covered with a light-transmitting protective layer or a fluorescent layer. However, the aforementioned details are disclosed for exemplary purposes only, and are not meant to limit the scope of the present disclosure.

Sixth Embodiment

Figure 18:
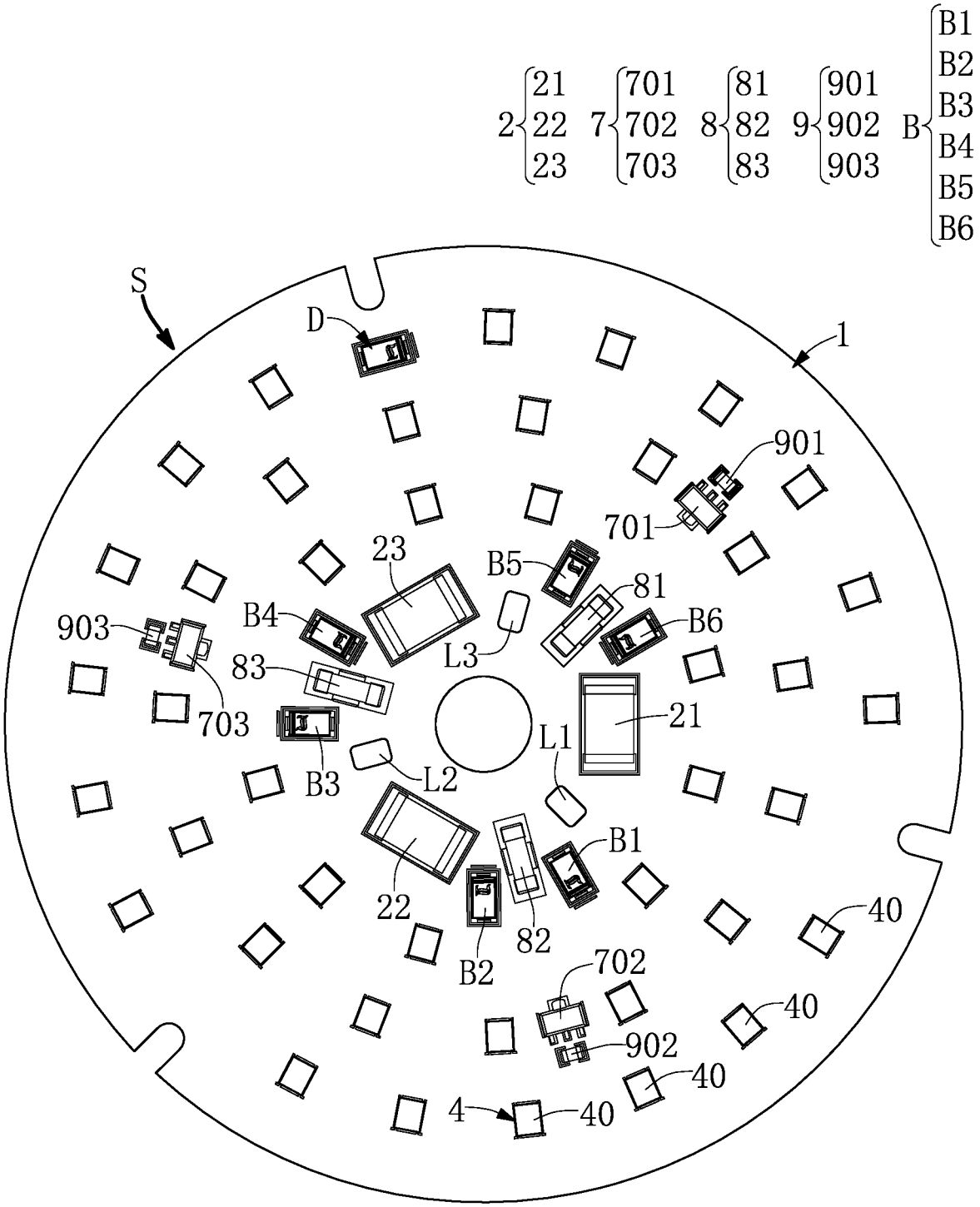
FIG. 18 is a schematic top view of the LED illuminating device according to a sixth embodiment of the present disclosure (when the LED chips are electrically connected to the circuit substrate by SMT)
Figure 19:
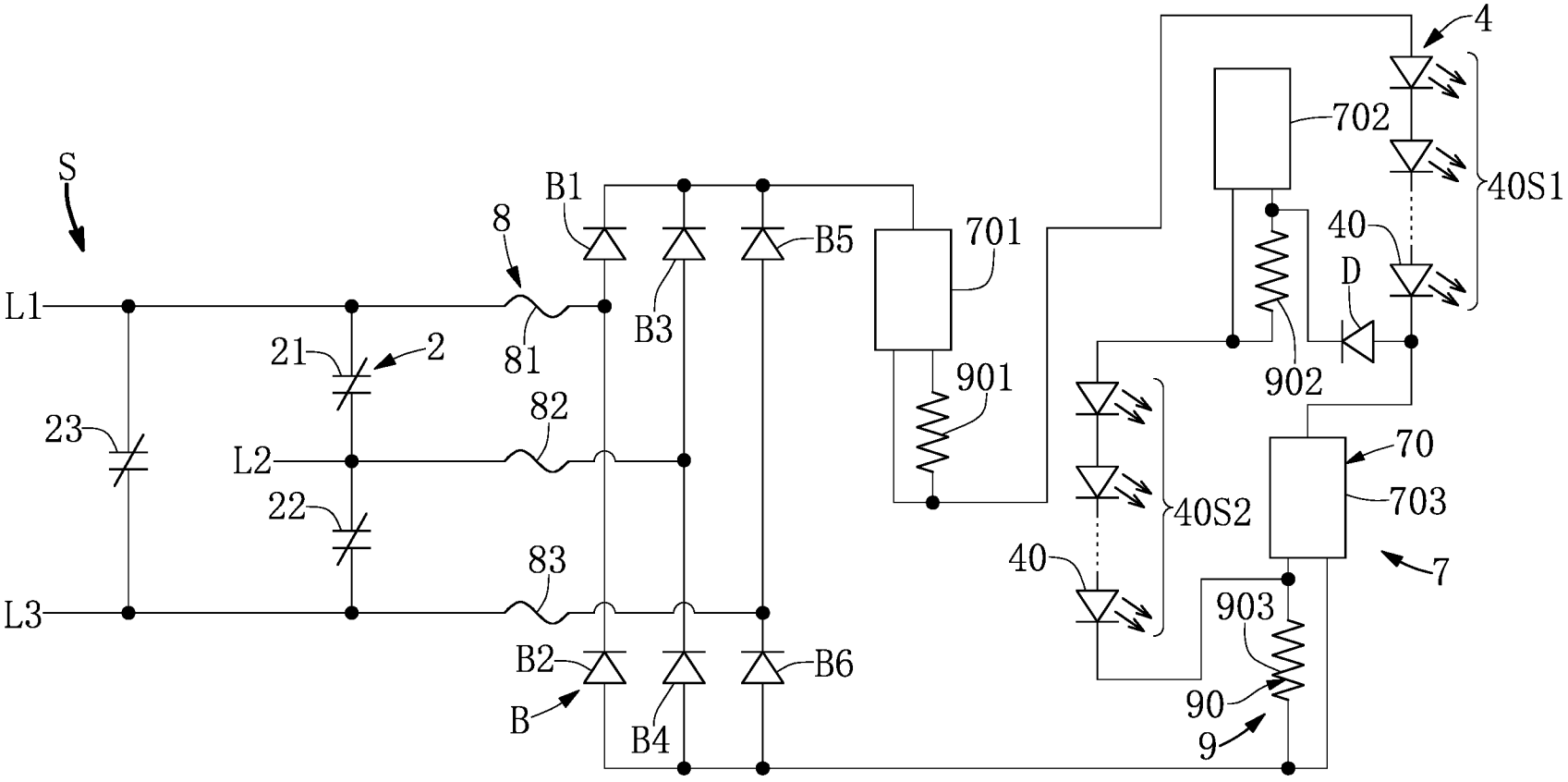
FIG. 19 is a schematic circuit diagram of the LED illuminating device according to the sixth embodiment of the present disclosure.

Referring to FIG. 18 and FIG. 19, a sixth embodiment of the present disclosure provides an LED illuminating device without using a capacitor, which at least includes a circuit substrate 1, a surge absorber group 2, a three-phase rectifier bridge module B, an LED chip group 4 and a current-limiting chip group 7. Comparing FIG. 18 with FIG. 15, and comparing FIG. 19 with FIG. 16, the main difference between the sixth embodiment and the fifth embodiment is as follows.

In the sixth embodiment, as shown in FIG. 18 and FIG. 19, the LED chips 40 of the LED chip group 4 can be divided into a first LED chip section 40S1 including at least two of the LED chips 40 arranged in series, and a second LED chip section 40S2 including at least another two of the LED chips 40 arranged in series, the first LED chip section 40S1 and the second LED chip section 40S2 of the LED chip group 4 are arranged in parallel, and the first LED chip section 40S1 and the second LED chip section 40S2 of the LED chip group 4 can be electrically connected with each other through a unidirectional conduction chip D (such as a one-way conduction chip). Moreover, one of the current-limiting chips 701 is electrically connected in series to the first LED chip section 40S1 of the LED chip group 4, another one of the current-limiting chips 702 is electrically connected in parallel to the first LED chip section 40S1 of the LED chip group 4, and yet another one of the current-limiting chips 703 is electrically connected in parallel to the second LED chip section 40S2 of the LED chip group 4.

It should be noted that as shown in FIG. 18 and FIG. 19, the current-limiting chip 701 is configured to limit the maximum current when the first LED chip section 40S1 and the second LED chip section 40S2 of the first LED chip group 4 are connected in series, and can provide a surge protection of at least 500V. Furthermore, the current-limiting chip 702 and the current-limiting chip 703 are configured to limit the maximum current when the first LED chip section 40S1 and the second LED chip section 40S2 of the first LED chip group 4 are connected in parallel, and the current-limiting chip 702 and the current-limiting chip 703 can be used as switches to serially connect the first LED chip section 40S1 and the second LED chip section 40S2 of the second LED chip group 4 when the voltage is increased. Moreover, the unidirectional conduction chip D can be configured to limit the current direction, so that the first LED chip section 40S1 and the second LED chip section 40S2 of the first LED chip group 4 can be connected in parallel through the unidirectional conduction chip D.

Figure 20:
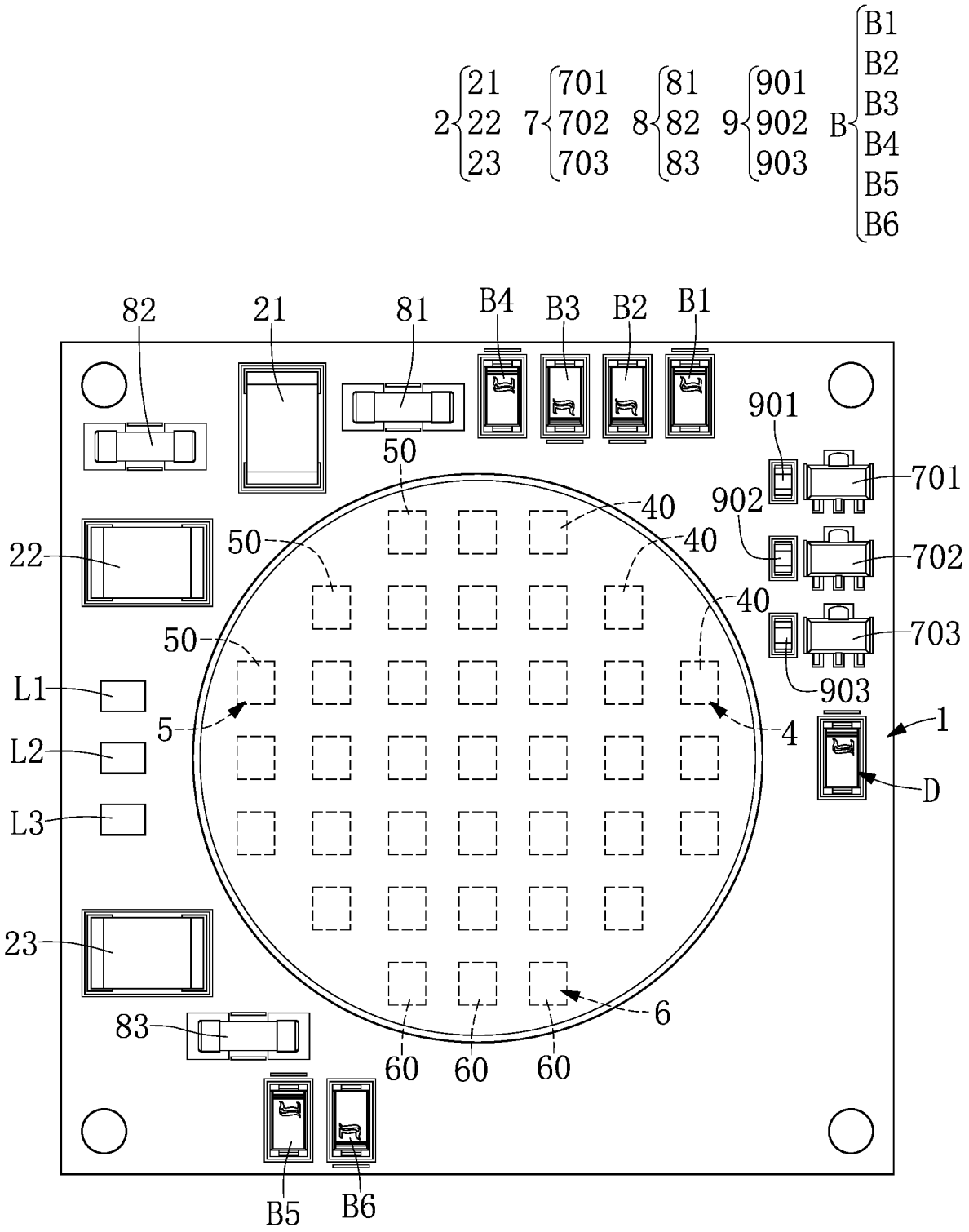
FIG. 20 is a schematic top view of another LED illuminating device according to the sixth embodiment of the present disclosure (when the LED chips are electrically connected to the circuit substrate by COB).

It should be noted that, for example, as shown in FIG. 20, the sixth embodiment of the present disclosure further provides another LED illuminating device, and the LED chips 40 can be electrically connected to the circuit substrate 1 by means of chip on board (COB). That is to say, when the LED chip 40 is a bare die and has not been packaged, the bare LED chip 40 can be electrically connected to the circuit substrate 1 by COB, and then the bare LED chip 40 can be covered with a light-transmitting protective layer or a fluorescent layer. However, the aforementioned details are disclosed for exemplary purposes only, and are not meant to limit the scope of the present disclosure.

Beneficial Effects of the Embodiments

One beneficial effect of the present disclosure is that the LED illuminating device can generate a lighting source required by a user through a three-phase power that can be provided by the first AC power input terminal L1, the second AC power input terminal L2 and the third AC power input terminal L3 of the three-phase power supply P by cooperation of the surge absorber group 2, the bridge rectifier group 3, the first LED chip group 4, the second LED chip group 5, the third LED chip group 6 and the current-limiting chip group 7.

Another beneficial effect of the present disclosure is that the LED illuminating device can generate a lighting source required by a user through a three-phase power that can be provided by the first AC power input terminal L1, the second AC power input terminal L2 and the third AC power input terminal L3 of the three-phase power supply P by cooperation of the surge absorber group 2, the three-phase rectifier bridge module B, the LED chip group 4 and the current-limiting chip group 7.

It is worth noting that, for example, when the LED illuminating device provided by the present disclosure uses a three-phase power supply P, the LED illuminating device can provide 3 times the frequency (for example, 3 times 100 Hz or 3 times 120 Hz), so that the chance of generating flicker by the LED illuminating device can be effectively reduced. Therefore, when the LED illuminating device is used in an environment where the rotating elements (such as fans) of some equipment need to be rotated, since the frequency provided by the LED illuminating device will be greater than the frequency of the rotating element of the equipment, the user will not mistake the rotating element as stationary to prevent unnecessary danger. Furthermore, since the LED illuminating device provided by the present disclosure does not need to use a capacitor, the LED illuminating device can be used in a higher temperature environment. In addition, since the LED illuminating device can provide a higher frequency, the user can use an image-capturing device to capture images of a moving element without being affected by the LED illuminating device. However, the aforementioned details are disclosed for exemplary purposes only, and are not meant to limit the scope of the present disclosure.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An LED illuminating device without using a capacitor, comprising:

a circuit substrate configured without the capacitor, wherein the circuit substrate includes a first alternating current (AC) power input terminal, a second AC power input terminal and a third AC power input terminal that are electrically connected to a three-phase power supply;

a surge absorber group disposed on the circuit substrate and electrically connected to the circuit substrate, wherein the surge absorber group includes a first surge absorber electrically connected between the first AC power input terminal and the second AC power input terminal, a second surge absorber electrically connected between the second AC power input terminal and the third AC power input terminal, and a third surge absorber electrically connected between the third AC power input terminal and the first AC power input terminal;

a bridge rectifier group disposed on the circuit substrate and electrically connected to the circuit substrate, wherein the bridge rectifier group includes a first bridge rectifier electrically connected between the first AC power input terminal and the second AC power input terminal, a second bridge rectifier electrically connected between the second AC power input terminal and the third AC power input terminal, and a third bridge rectifier electrically connected between the third AC power input terminal and the first AC power input terminal;

a first LED chip group disposed on the circuit substrate and electrically connected to the circuit substrate, wherein the first LED chip group is electrically connected to the first bridge rectifier, and the first LED chip group includes a plurality of first LED chips;

a second LED chip group disposed on the circuit substrate and electrically connected to the circuit substrate, wherein the second LED chip group is electrically connected to the second bridge rectifier, and the second LED chip group includes a plurality of second LED chips;

a third LED chip group disposed on the circuit substrate and electrically connected to the circuit substrate, wherein the third LED chip group is electrically connected to the third bridge rectifier, and the third LED chip group includes a plurality of third LED chips; and a current-limiting chip group disposed on the circuit substrate and electrically connected to the circuit substrate, wherein the current-limiting chip group is electrically connected to the bridge rectifier group.

2. The LED illuminating device without using the capacitor according to claim 1, further comprising:

a fuse chip group disposed on the circuit substrate and electrically connected to the circuit substrate, wherein the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier; and a resistor chip group disposed on the circuit substrate and electrically connected to the circuit substrate, wherein the resistor chip group includes a first resistor chip, a second resistor chip and a third resistor chip;

wherein the current-limiting chip group includes a first current-limiting chip electrically connected between the first LED chip group and the first bridge rectifier, a second current-limiting chip electrically connected between the second LED chip group and the second bridge rectifier, and a third current-limiting chip electrically connected between the third LED chip group and the third bridge rectifier;

wherein the first LED chips of the first LED chip group are electrically connected in series between the first bridge rectifier and the first current-limiting chip, the second LED chips of the second LED chip group are electrically connected in series between the second bridge rectifier and the second current-limiting chip, and the third LED chips of the third LED chip group are electrically connected in series between the third bridge rectifier and the third current-limiting chip;

wherein the first resistor chip is electrically connected to the first current-limiting chip, the second resistor chip is electrically connected to the second current-limiting chip, and the third resistor chip is electrically connected to the third current-limiting chip.

3. The LED illuminating device without using the capacitor according to claim 1, further comprising:

a fuse chip group disposed on the circuit substrate and electrically connected to the circuit substrate, wherein the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier; and a resistor chip group disposed on the circuit substrate and electrically connected to the circuit substrate, wherein the resistor chip group includes a plurality of first resistor chips, a plurality of second resistor chips and a plurality of third resistor chips;

wherein the current-limiting chip group includes a plurality of first current-limiting chips electrically connected between the first LED chip group and the first bridge rectifier, a plurality of second current-limiting chips electrically connected between the second LED chip group and the second bridge rectifier, and a plurality of third current-limiting chips electrically connected between the third LED chip group and the third bridge rectifier, the first current-limiting chips are arranged in parallel with each other, the second current-limiting chips are arranged in parallel with each other, and the third current-limiting chips are arranged in parallel with each other;

wherein the first LED chips of the first LED chip group are divided into a first LED chip section including at least two of the first LED chips arranged in series, a second LED chip section including at least another two of the first LED chips arranged in series, and a third LED chip section including at least yet another two of the first LED chips arranged in series, and the first LED chip section, the second LED chip section and the third LED chip section of the first LED chip group are arranged in series;

wherein one of the first current-limiting chips is electrically connected in parallel between the first LED chip section and the second LED chip section of the first LED chip group, another one of the first current-limiting chips is electrically connected in parallel between the second LED chip section and the third LED chip section of the first LED chip group, and yet another one of the first current-limiting chips is electrically connected in series to the third LED chip section of the first LED chip group;

wherein the second LED chips of the second LED chip group are divided into a first LED chip section including at least two of the second LED chips arranged in series, a second LED chip section including at least another two of the second LED chips arranged in series, and a third LED chip section including at least yet another two of the second LED chips arranged in series, and the first LED chip section, the second LED chip section and the third LED chip section of the second LED chip group are arranged in series;

wherein one of the second current-limiting chips is electrically connected in parallel between the first LED chip section and the second LED chip section of the second LED chip group, another one of the second current-limiting chips is electrically connected in parallel between the second LED chip section and the third LED chip section of the second LED chip group, and yet another one of the second current-limiting chips is electrically connected in series to the third LED chip section of the second LED chip group;

wherein the third LED chips of the third LED chip group are divided into a first LED chip section including at least two of the third LED chips arranged in series, a second LED chip section including at least another two of the third LED chips arranged in series, and a third LED chip section including at least yet another two of the third LED chips arranged in series, and the first LED chip section, the second LED chip section and the third LED chip section of the third LED chip group are arranged in series;

wherein one of the third current-limiting chips is electrically connected in parallel between the first LED chip section and the second LED chip section of the third LED chip group, another one of the third current-limiting chips is electrically connected in parallel between the second LED chip section and the third LED chip section of the third LED chip group, and yet another one of the third current-limiting chips is electrically connected in series to the third LED chip section of the third LED chip group;

wherein the first resistor chips are respectively electrically connected to the first current-limiting chips, the second resistor chips are respectively electrically connected to the second current-limiting chips, and the third resistor chips are respectively electrically connected to the third current-limiting chips.

4. The LED illuminating device without using the capacitor according to claim 1, further comprising:

a fuse chip group disposed on the circuit substrate and electrically connected to the circuit substrate, wherein the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier; and a resistor chip group disposed on the circuit substrate and electrically connected to the circuit substrate, wherein the resistor chip group includes a plurality of first resistor chips, a plurality of second resistor chips and a plurality of third resistor chips;

wherein the current-limiting chip group includes a plurality of first current-limiting chips arranged in parallel with each other, a plurality of second current-limiting chips arranged in parallel with each other, and a plurality of third current-limiting chips arranged in parallel with each other;

wherein the first LED chips of the first LED chip group are divided into a first LED chip section including at least two of the first LED chips arranged in series, and a second LED chip section including at least another two of the first LED chips arranged in series, the first LED chip section and the second LED chip section of the first LED chip group are arranged in parallel, and the first LED chip section and the second LED chip section of the first LED chip group are electrically connected with each other through a first unidirectional conduction chip;

wherein one of the first current-limiting chips is electrically connected in series to the first LED chip section of the first LED chip group, another one of the first current-limiting chips is electrically connected in parallel to the first LED chip section of the first LED chip group, and yet another one of the first current-limiting chips is electrically connected in parallel to the second LED chip section of the first LED chip group;

wherein the second LED chips of the second LED chip group are divided into a first LED chip section including at least two of the second LED chips arranged in series, and a second LED chip section including at least another two of the second LED chips arranged in series, the first LED chip section and the second LED chip section of the second LED chip group are arranged in parallel, and the first LED chip section and the second LED chip section of the second LED chip group are electrically connected with each other through a second unidirectional conduction chip;

wherein one of the second current-limiting chips is electrically connected in series to the first LED chip section of the second LED chip group, another one of the second current-limiting chips is electrically connected in parallel to the first LED chip section of the second LED chip group, and yet another one of the second current-limiting chips is electrically connected in parallel to the second LED chip section of the second LED chip group;

wherein the third LED chips of the third LED chip group are divided into a first LED chip section including at least two of the third LED chips arranged in series, and a second LED chip section including at least another two of the third LED chips arranged in series, the first LED chip section and the second LED chip section of the third LED chip group are arranged in parallel, and the first LED chip section and the second LED chip section of the third LED chip group are electrically connected with each other through a third unidirectional conduction chip;

wherein one of the third current-limiting chips is electrically connected in series to the first LED chip section of the third LED chip group, another one of the third current-limiting chips is electrically connected in parallel to the first LED chip section of the third LED chip group, and yet another one of the third current-limiting chips is electrically connected in parallel to the second LED chip section of the third LED chip group;

wherein the first resistor chips are respectively electrically connected to the first current-limiting chips, the second resistor chips are respectively electrically connected to the second current-limiting chips, and the third resistor chips are respectively electrically connected to the third current-limiting chips.

5. The LED illuminating device without using the capacitor according to claim 1, further comprising:

a fuse chip group disposed on the circuit substrate and electrically connected to the circuit substrate, wherein the fuse chip group includes a first fuse chip electrically connected to the first AC power input terminal and the first bridge rectifier, a second fuse chip electrically connected between the second AC power input terminal and the second bridge rectifier, and a third fuse chip electrically connected between the third AC power input terminal and the third bridge rectifier; and a resistor chip group disposed on the circuit substrate and electrically connected to the circuit substrate, wherein the resistor chip group includes at least one first resistor chip, at least one second resistor chip and at least one third resistor chip;

wherein the first LED chip group, the second LED chip group and the third LED chip group are disposed on the same circuit substrate and electrically connected to the same circuit substrate, and the current-limiting chip group includes at least one first current-limiting chip, at least one second current-limiting chip, and at least one third current-limiting chip;

wherein the first surge absorber, the first fuse chip, the first bridge rectifier, the first LED chip group, the at least one first current-limiting chip and the at least one first resistor chip cooperate with each other to form a first light-emitting assembly;

wherein the second surge absorber, the second fuse chip, the second bridge rectifier, the second LED chip group, the at least one second current-limiting chip and the at least one second resistor chip cooperate with each other to form a second light-emitting assembly;

wherein the third surge absorber, the third fuse chip, the third bridge rectifier, the third LED chip group, the at least one third current-limiting chip and the at least one third resistor chip cooperate with each other to form a third light-emitting assembly.

6. An LED illuminating device without using a capacitor, comprising:

a circuit substrate configured without the capacitor, wherein the circuit substrate includes a first alternating current (AC) power input terminal, a second AC power input terminal and a third AC power input terminal that are electrically connected to a three-phase power supply;

a surge absorber group disposed on the circuit substrate and electrically connected to the circuit substrate, wherein the surge absorber group includes a first surge absorber electrically connected between the first AC power input terminal and the second AC power input terminal, a second surge absorber electrically connected between the second AC power input terminal and the third AC power input terminal, and a third surge absorber electrically connected between the third AC power input terminal and the first AC power input terminal;

a three-phase rectifier bridge module disposed on the circuit substrate and electrically connected to the circuit substrate, wherein the three-phase rectifier bridge module is electrically connected to the first AC power input terminal, the second AC power input terminal and the third AC power input terminal;

an LED chip group disposed on the circuit substrate and electrically connected to the circuit substrate, wherein the LED chip group is electrically connected to the three-phase rectifier bridge module, and the LED chip group includes a plurality of LED chips; and a current-limiting chip group disposed on the circuit substrate and electrically connected to the circuit substrate, wherein the current-limiting chip group is electrically connected to the three-phase rectifier bridge module.

7. The LED illuminating device without using the capacitor according to claim 6, further comprising:

a fuse chip group disposed on the circuit substrate and electrically connected to the circuit substrate, wherein the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module; and a resistor chip group disposed on the circuit substrate and electrically connected to the circuit substrate, wherein the resistor chip group includes a resistor chip;

wherein the current-limiting chip group includes a current-limiting chip electrically connected between the LED chip group and the three-phase rectifier bridge module;

wherein the LED chips of the LED chip group are electrically connected in series between the three-phase rectifier bridge module and the current-limiting chip;

wherein the resistor chip is electrically connected to the current-limiting chip.

8. The LED illuminating device without using the capacitor according to claim 6, further comprising:

a fuse chip group disposed on the circuit substrate and electrically connected to the circuit substrate, wherein the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module; and a resistor chip group disposed on the circuit substrate and electrically connected to the circuit substrate, wherein the resistor chip group includes a plurality of resistor chips;

wherein the current-limiting chip group includes a plurality of current-limiting chips electrically connected between the LED chip group and the three-phase rectifier bridge module, and the current-limiting chips are arranged in parallel with each other;

wherein the LED chips of the LED chip group are divided into a first LED chip section including at least two of the LED chips arranged in series, a second LED chip section including at least another two of the LED chips arranged in series, and a third LED chip section including at least yet another two of the LED chips arranged in series, and the first LED chip section, the second LED chip section and the third LED chip section of the LED chip group are arranged in series;

wherein one of the current-limiting chips is electrically connected in parallel between the first LED chip section and the second LED chip section of the LED chip group, another one of the current-limiting chips is electrically connected in parallel between the second LED chip section and the third LED chip section of the LED chip group, and yet another one of the current-limiting chips is electrically connected in series to the third LED chip section of the LED chip group;

wherein the resistor chips are respectively electrically connected to the current-limiting chips.

9. The LED illuminating device without using the capacitor according to claim 6, further comprising:

a fuse chip group disposed on the circuit substrate and electrically connected to the circuit substrate, wherein the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module; and a resistor chip group disposed on the circuit substrate and electrically connected to the circuit substrate, wherein the resistor chip group includes a plurality of resistor chips;

wherein the current-limiting chip group includes a plurality of current-limiting chips arranged in parallel with each other;

wherein the LED chips of the LED chip group are divided into a first LED chip section including at least two of the LED chips arranged in series, and a second LED chip section including at least another two of the LED chips arranged in series, the first LED chip section and the second LED chip section of the LED chip group are arranged in parallel, and the first LED chip section and the second LED chip section of the LED chip group are electrically connected with each other through a unidirectional conduction chip;

wherein one of the current-limiting chips is electrically connected in parallel between the first LED chip section and the second LED chip section of the LED chip group, another one of the current-limiting chips is electrically connected in parallel to the first LED chip section of the LED chip group, and yet another one of the current-limiting chips is electrically connected in series to the second LED chip section of the LED chip group;

wherein the resistor chips are respectively electrically connected to the current-limiting chips.

10. The LED illuminating device without using the capacitor according to claim 1, further comprising:

a fuse chip group disposed on the circuit substrate and electrically connected to the circuit substrate, wherein the fuse chip group includes a first fuse chip electrically connected to the first AC power input terminal and the three-phase rectifier bridge module, a second fuse chip electrically connected between the second AC power input terminal and the three-phase rectifier bridge module, and a third fuse chip electrically connected between the third AC power input terminal and the three-phase rectifier bridge module; and a resistor chip group disposed on the circuit substrate and electrically connected to the circuit substrate, wherein the resistor chip group includes at least one resistor chip;

wherein the first surge absorber, the second surge absorber, the third surge absorber, the first fuse chip, the second fuse chip, the third fuse chip, the three-phase rectifier bridge module, the LED chip group, the at least one current-limiting chip of the current-limiting chip group, and the at least one resistor chip cooperate with each other to form a light-emitting assembly;

wherein the three-phase rectifier bridge module includes a first electronic component, a second electronic component, a third electronic component, a fourth electronic component, a fifth electronic component and a sixth electronic component, the first AC power input terminal is electrically connected to the first electronic component and the second electronic component, the second AC power input terminal is electrically connected to the third electronic component and the fourth electronic component, and the third AC power input terminal is electrically connected to the fifth electronic component and the sixth electronic component.

* * * * *